US011149460B2

(12) United States Patent
Lee et al.

(10) Patent No.: US 11,149,460 B2
(45) Date of Patent: Oct. 19, 2021

(54) PARKING SYSTEM

(71) Applicants: EFFECT PARKING LIMITED (HONG KONG), Hong Kong (CN); George Wing Chung Lee, Markham (CA)

(72) Inventors: George Wing Chung Lee, Markham (CA); Man Wing Lee, Hong Kong (CN)

(73) Assignee: EFFECT PARKING LIMITED, Hong Kong (CN)

( * ) Notice: Subject to any disclaimer, the term of this patent is extended or adjusted under 35 U.S.C. 154(b) by 0 days.

(21) Appl. No.: 16/607,614

(22) PCT Filed: May 4, 2018

(86) PCT No.: PCT/CA2018/050535

§ 371 (c)(1),
(2) Date: Oct. 23, 2019

(87) PCT Pub. No.: WO2018/201258

PCT Pub. Date: Nov. 8, 2018

(65) Prior Publication Data

US 2020/0173187 A1 Jun. 4, 2020

(30) Foreign Application Priority Data

May 5, 2017 (CA) ..... CA 2966236

(51) Int. Cl.

| | |
|---|---|
| ***E04H 6/18*** | (2006.01) |
| ***B66F 7/02*** | (2006.01) |
| *B66F 7/28* | (2006.01) |

(52) U.S. Cl.
CPC ..... *E04H 6/182* (2013.01); *B66F 7/02* (2013.01); *B66F 7/28* (2013.01)

(58) Field of Classification Search
CPC . B66F 7/02; E04H 6/182; E04H 6/285; E04H 6/305

(Continued)

(56) References Cited

U.S. PATENT DOCUMENTS 2,904,200 A * 9/1959 Diehl ..... E04H 6/305 414/459
4,904,146 A * 2/1990 Lock ..... B60P 3/125 414/430

(Continued)

FOREIGN PATENT DOCUMENTS

WO WO-02099228 A1 * 12/2002 ..... E04H 6/305

*Primary Examiner* — James Keenan
(74) *Attorney, Agent, or Firm* — Ridout & Maybee LLP

(57) ABSTRACT

A parking system is described. The system includes a parking tower. The parking tower includes at least two levels and a vertical passageway. A vehicle gripping system is provided. The vehicle gripping system includes a 5 vertical lift frame vertically movable in the passageway. The vehicle gripping system also includes a horizontal slide frame slidably coupled to the vertical lift frame and horizontally movable relative to the vertical lift frame and across each level. A sliding wheel gripper is slidably coupled to and extending downwards from the horizontal slide frame, for releasably gripping a vehicle 10 by gripping the wheels of the vehicle. The sliding wheel gripper is longitudinally slidable along the horizontal slide frame between a release position and a gripping position.

11 Claims, 33 Drawing Sheets

(58) Field of Classification Search
USPC ..... 414/260, 460
See application file for complete search history.

(56) References Cited

U.S. PATENT DOCUMENTS

| | | | | | |
|---|---|---|---|---|---|
| 4,971,506 | A * | 11/1990 | Givati | E04H 6/182 | 414/256 |
| 5,022,808 | A * | 6/1991 | Blum | B65G 1/0435 | 414/260 |
| 5,286,156 | A * | 2/1994 | Ikenouchi | E04H 6/183 | 414/256 |
| 6,328,521 | B1 * | 12/2001 | Givati | E04H 6/22 | 414/234 |
| 7,461,733 | B2 * | 12/2008 | Dohi | B62D 65/18 | 198/345.1 |
| 2015/0139764 | A1 * | 5/2015 | Jang | B66F 7/12 | 414/458 |

* cited by examiner

PARKING SYSTEM

TECHNICAL FIELD

The present invention relates to a parking facility for vehicles, in particular an automated parking facility with a vehicle lift for storage of vehicles.

BACKGROUND

With the increasing number of vehicles in the world, particularly in the cities, the demand for parking spaces have led to various solutions for more efficient of parking spaces. One of the solutions is vertically storing the vehicles in a space in which the height of each level is smaller than that of traditional drive-in parking spaces.

SUMMARY

This disclosure provides a modular vehicle parking system. Each module is a multi-level parking tower, which includes a vertical lift frame, a horizontal slide frame and a sliding wheel gripper. In use, the sliding wheel gripper grips a vehicle by the wheels and the vertical lift frame moves the vehicle vertically to a parking level in the parking system. The horizontal slide frame then moves the vehicle horizontally to the parking space on the parking level and the vehicle is released from the gripper.

Two or more multi-level parking towers may be used together in a system, depending on the requirements of the operators. By using multiple multi-level parking towers, which are capable of operating simultaneously, the wait to park or retrieve vehicles may be shortened.

The multi-level parking towers may be shipped fully-assembled for efficient freight and speeds up on-site installation.

Vertical spacing in each multi-level parking tower may be selected to accommodate different heights of the parking garage.

The parking system may be used underground, above ground or as a combination of both.

Solar or electricity powered electric vehicle (EV) chargers may be installed in designated parking spots. Solar panels may be installed on top of the multi-level parking towers for generating electricity to charge the vehicles and/or operate the motors used to lift and lower the vehicles.

In some aspects, the present disclosure provides a vehicle gripping system. The vehicle gripping system includes a sliding wheel gripper slidably coupled to and extending downwards from an upper frame, for releasably gripping a vehicle by gripping the wheels of the vehicle. The sliding wheel gripper is longitudinally slidable along the upper frame between a release position and a gripping position. The sliding wheel gripper includes first and second arms extending downwards from the upper frame. The first and second arms are longitudinally movable towards each other to the gripping position to enable gripping of the vehicle therebetween, and longitudinally movable away from each other to the release position to enable release of the vehicle.

In some examples, the sliding wheel gripper includes a first top frame and a second top frame slidably movable in opposite directions relative to the upper frame, and the first and second arms extend downwardly from the first and second top frames, respectively.

In some examples, the vehicle gripping system includes first and second gripping devices disposed at a lower end of the first and second arms, respectively, for gripping the vehicle therebetween.

In some examples, each of the first and second gripping devices includes two rotary shafts for supporting the vehicle wheel thereupon; and a liftable stopper for gripping a side of the vehicle wheel. The vehicle is gripped between the first and second gripping devices by pressure from the respective stoppers.

In some examples, each of the first and second gripping devices includes a rotary mechanism to cause the liftable stopper to move from a rest position to a raised gripping position.

In some examples, the vehicle gripping system includes a first cable system for moving the first and second arms away from each other, and a second cable system for moving the first and second arms towards each other. The first and second cable systems are configured to cause movement of the first and second arms away from each other to release the vehicle to be at a slower speed than movement of the first and second arms towards each other to grip the vehicle.

In some examples, the vehicle gripping system includes a cable lifting arm for moving the second cable system between an upper position and to a lower position.

In some examples, the vehicle gripping system includes at least one pressure sensing unit on at least one arm. The pressure sensing unit is configured to detect lowering of the second cable system to the lower position. The pressure sensing unit is configured to cause the second cable system to decelerate movement of the first and second arms towards each other.

In some examples, the vehicle gripping system includes a tension sensing unit positioned to sense tension in the second cable system. The tension sensing unit is configured to detect when tension in the second cable system reaches a threshold tension indicating a vehicle has been gripped. The tension sensing unit is configured to cause the second cable system to stop movement of the first and second arms.

In some aspects, the present disclosure provides a parking tower. The parking tower includes a structure having at least two levels and a vertical passageway and a vehicle gripping system. The vehicle gripping system includes a vertical lift frame vertically movable in the passageway. The vehicle gripping system also includes a horizontal slide frame slidably coupled to the vertical lift frame and horizontally movable relative to the vertical lift frame and across each level. The vehicle gripping system also includes a sliding wheel gripper slidably coupled to and extending downwards from the horizontal slide frame, for releasably gripping a vehicle by gripping the wheels of the vehicle, the sliding wheel gripper being longitudinally slidable along the horizontal slide frame between a release position and a gripping position.

In some examples, at least one parking bay and at least one parking spot is defined in the structure. Each of the parking bay and parking spot is provided with horizontal fixed members to enable horizontal movement of the horizontal slide frame across the respective parking bay and parking spot.

In some examples, the vehicle gripping system includes a pin system. The pin system includes retractable pins movable between an unanchored position and an anchored position, wherein the anchored position of the retractable pins causes the vertical lift frame to be anchored to the fixed members of the parking spot or parking bay. The pin system includes orientation sensing units configured to sense orientation of the retractable pins. Orientation of the retractable pins is indicative of whether the vertical lift frame is substantially level with the fixed members of the parking spot or parking bay. The orientation sensing units are configured to cause vertical movement of the vertical lift frame to stop when the vertical lift frame is substantially level. The pin system also includes biasing members controllable to cause movement of the retractable pins between the unanchored position and the anchored position.

In some examples, the vertical lift frame is substantially level when there is a vertical difference of 0.5 mm or less between the vertical lift frame and the fixed members.

In some examples, the parking tower includes any of the sliding wheel gripper described above.

In some examples, a parking system includes a plurality of any of the parking tower described above.

BRIEF DESCRIPTION OF THE DRAWINGS

Reference will now be made, by way of example, to the accompanying drawings which show example embodiments of the present application, and in which:

FIG. 2A-1 is a close-up view of one end of the vertical lift frame of FIG. 2;

FIG. 2C-1 is a close-up view of one end of the horizontal slide frame of FIG. 2;

FIG. 2C-2 is a close-up view illustrating cooperation of sensors on the vertical lift frame and horizontal slide frame of FIG. 2;

DETAILED DESCRIPTION OF THE INVENTION

Figure 1:
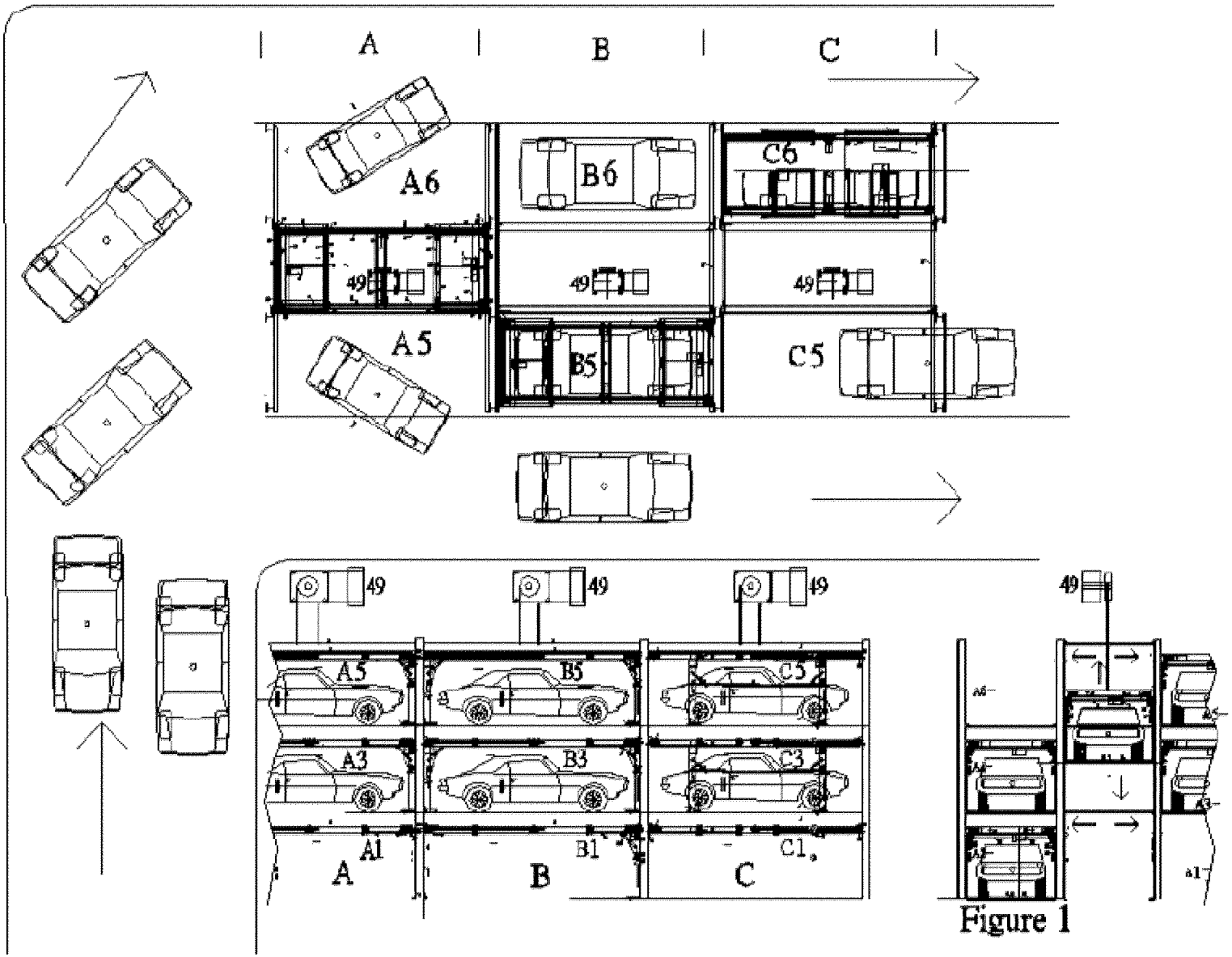
FIG. 1 shows a top plan view, side elevational view and front elevational view of one embodiment of the system, which includes three multi-level parking towers.
Figure 1A:
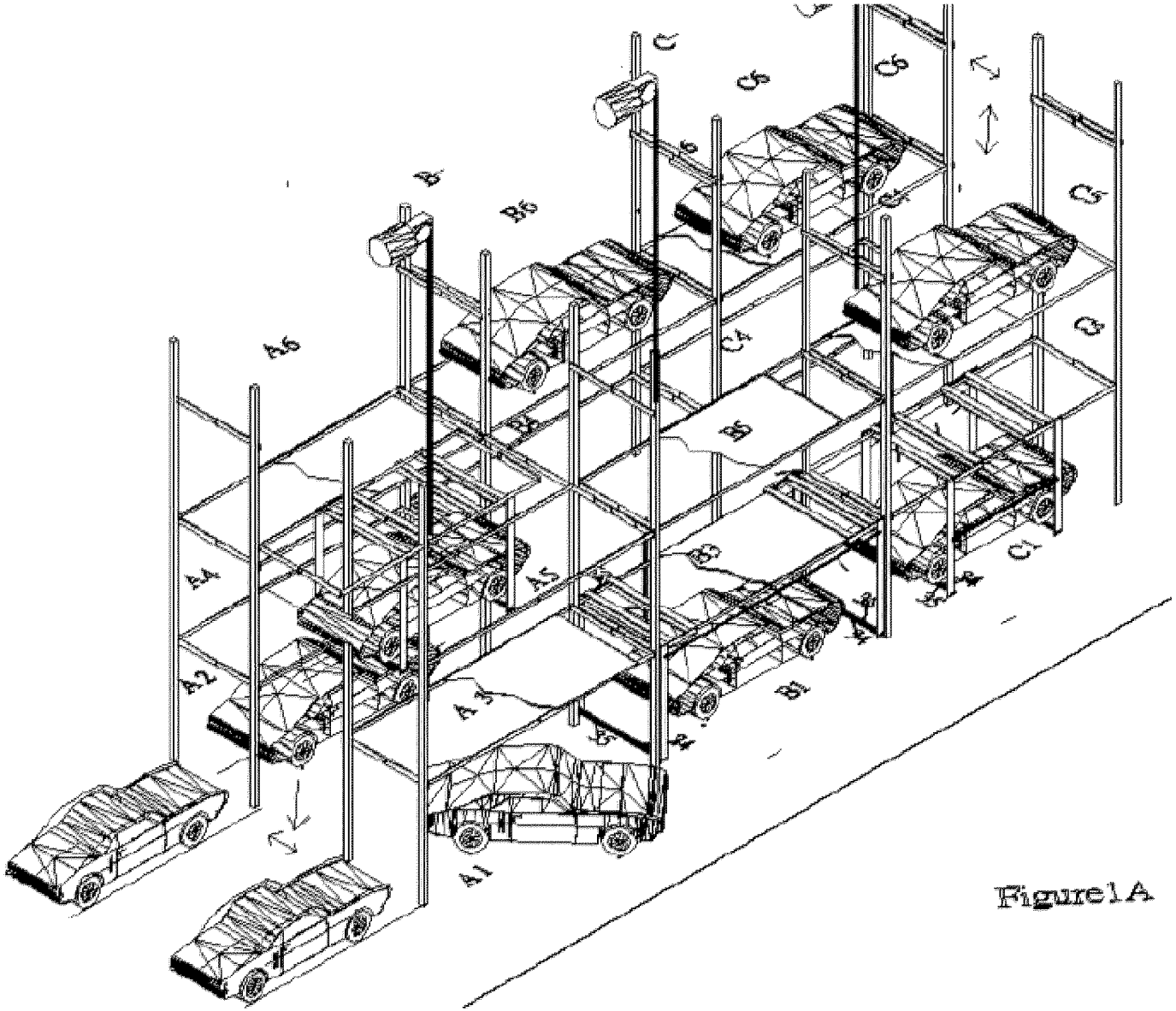
FIG. 1A shows a perspective view of the embodiment of FIG. 1.
Figure 1B:
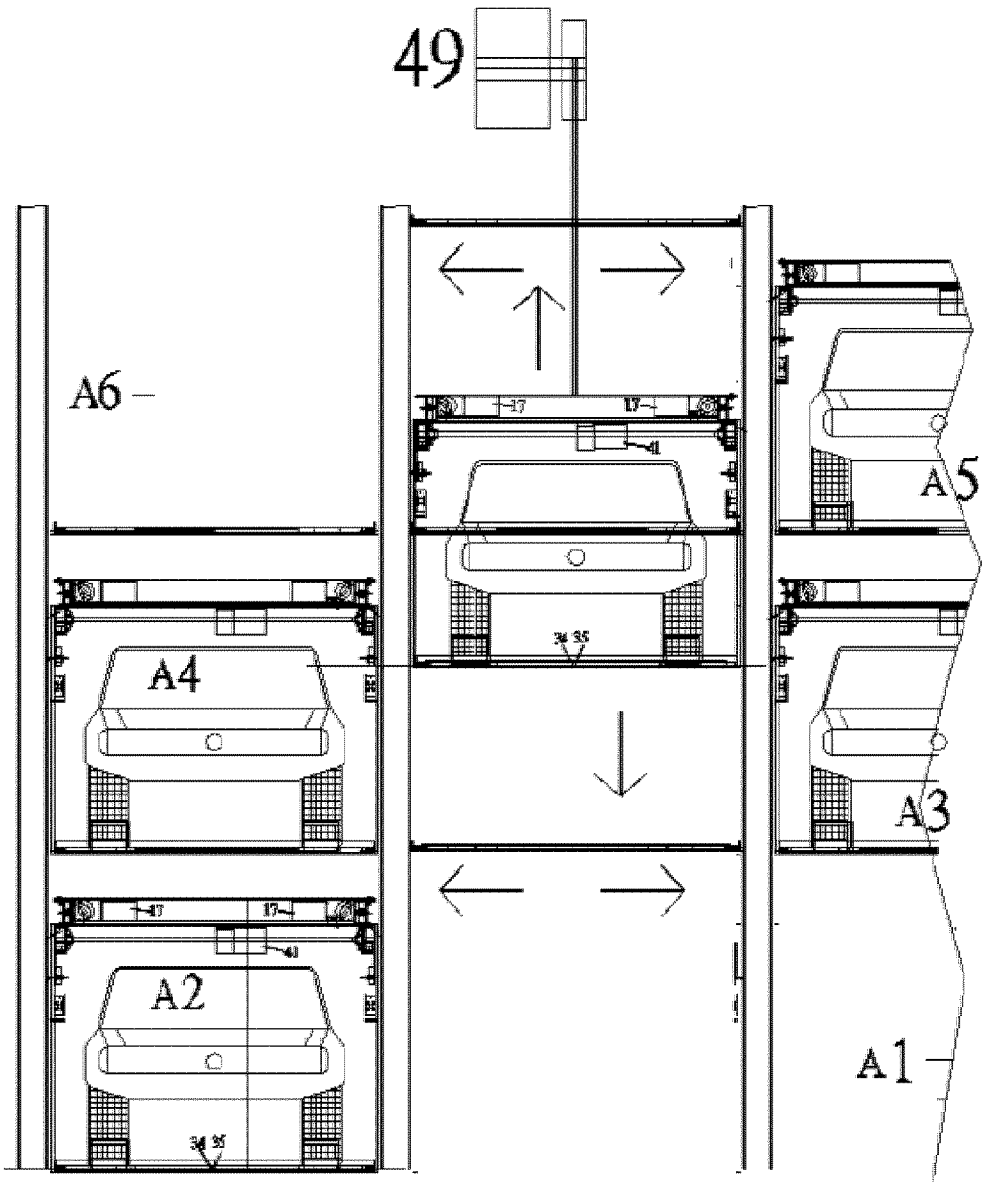
FIG. 1B shows the front elevational view of one multi-level parking tower of the embodiment of FIG. 1.

FIG. 1 shows a top plan view, side elevational view and a front elevational view of an example parking system in use. FIG. 1A shows a perspective view of the example parking system in use. FIG. 1B shows the front elevational view of multi-level parking tower. The system as shown includes three multi-level parking towers A, B, C. Thus, there are three motors 49 for lifting and lowering the vehicles (described further below). The three multi-level parking towers A, B and C are arranged along the direction of the length of the vehicles. It is understood that the multi-level parking towers A, B, C may alternatively or additionally be arranged along the direction of the width of the vehicles. Each multi-level parking tower A, B, C is a structure having at least two levels and a vertical passageway. In this example, each parking tower A, B, C is shown to have three levels. A parking system may have one or more multi-level parking towers A, B, C arranged together. It is understood that each multi-level parking tower A, B, C may have more or fewer levels, for example depending on the needs of the operators and/or the space available.

As shown in the top plan view, each multi-level parking tower A, B, C may have multiple parking spots on each level. Each parking spot has two opposing longitudinal sides and two opposing ends. Vehicles may enter and exit multi-level parking towers at an entry level (e.g., ground level) from the longitudinal sides or the ends, as shown. In some examples, there are two parking spots on each level of each multi-level parking tower A, B, C. One or more of the parking spots on the entry level may be used as parking bays for the users to drop off and pick off vehicles. It should be understood that the parking bay may be substantially the same as the parking spots in configuration, and differ only in how the parking bay is used (to drop off or pick up a vehicle) compared to the parking spots (to park a vehicle). Thus, the following descriptions with respect to a parking spot may also be applicable to the parking bay.

FIGS. 1, 1A and 1B show the vehicles stored vertically one above the other, thus efficient usage of the parking garage spaces may be achieved. It is understood that the height of each parking spot, each level and/or the multi-level parking tower may be adjusted to accommodate vehicles of different height and to maximize the efficiency of space usage. The height may be adjusted by any suitable means. A passageway A7 in the parking tower allows a gripping system (described further below) to move upwardly and downwardly, for vertical positioning of a gripped vehicle, as illustrated in FIG. 1B.

Figure 2:
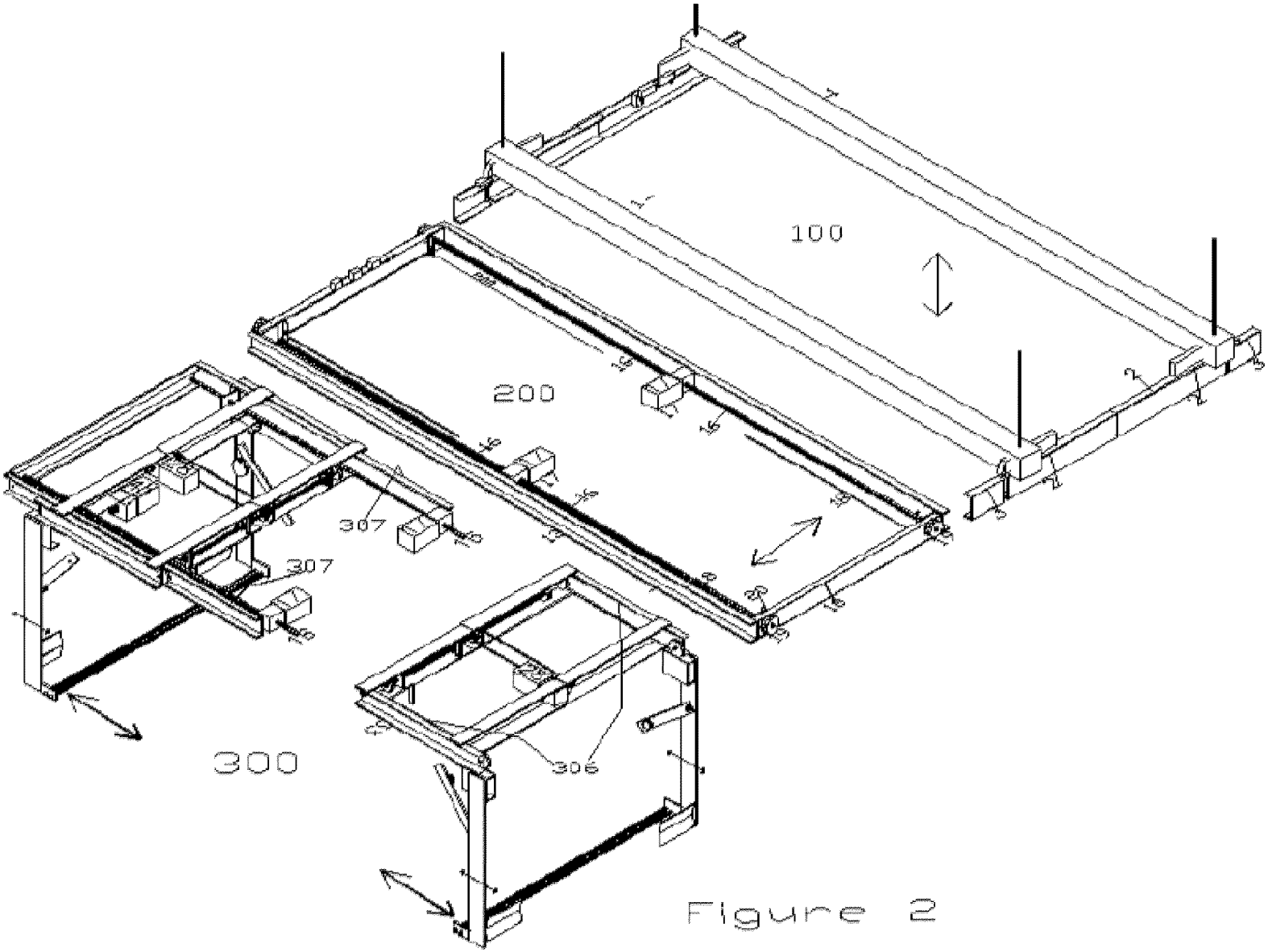
FIG. 2 shows a perspective view of a vertical lift frame, a horizontal slide frame and a sliding wheel gripper of one embodiment of the disclosure.

FIG. 2 shows elements for gripping and moving a vehicle in the disclosed parking system, including a vertical lift frame 100, a horizontal slide frame 200 and a sliding wheel gripper 300, in an example embodiment.

Referring to Figure s2A and 2A-1, the vertical lift frame 100 includes two opposing longitudinal lift frame sides 1 and two opposing lift frame ends 2. Each end of a frame side 1 is connected to one end of a frame end 2. Thus, the frame sides 1 and frame ends 2 are connected to each other to define a substantially rectangular vertical lift frame 100. The longitudinal lift frame sides 1 in this example are rectangular tubes. The lift frame ends 2 in this example are transverse U-channels. The lift frame longitudinal lift frame side 1 and the lift frame ends 2 may be made of steel.

The vertical lift frame 100 may be anchored to and unanchored from the multi-level parking tower. In an example, the lift frame ends 2 may anchor to respective fixed members (which may also be formed as transverse U-channels) positioned at each parking sport and described further below.

Means may be provided to lift and/or lower the vertical lift frame 100. For example, one or more motors may be provided to lift and/or lower the vertical lift frame 100. In some examples, the two lift frame longitudinal sides 1 are connected to four cables, each end of a lift frame longitudinal side 1 being connected to one cable. In some examples, a motor 49 (see FIG. 4D) may be connected to the four cables in any suitable manner so that the motor 49 can lift and lower the vertical lift frame 100 in the passageway A7, while the vertical lift frame 100 remains substantially parallel to the ground.

In some examples, the two lift frame ends 2 are fixed below the two lift frame longitudinal sides 1. In some examples, the vertical lift frame is centrally disposed within the passageway A7.

Figure 2A:
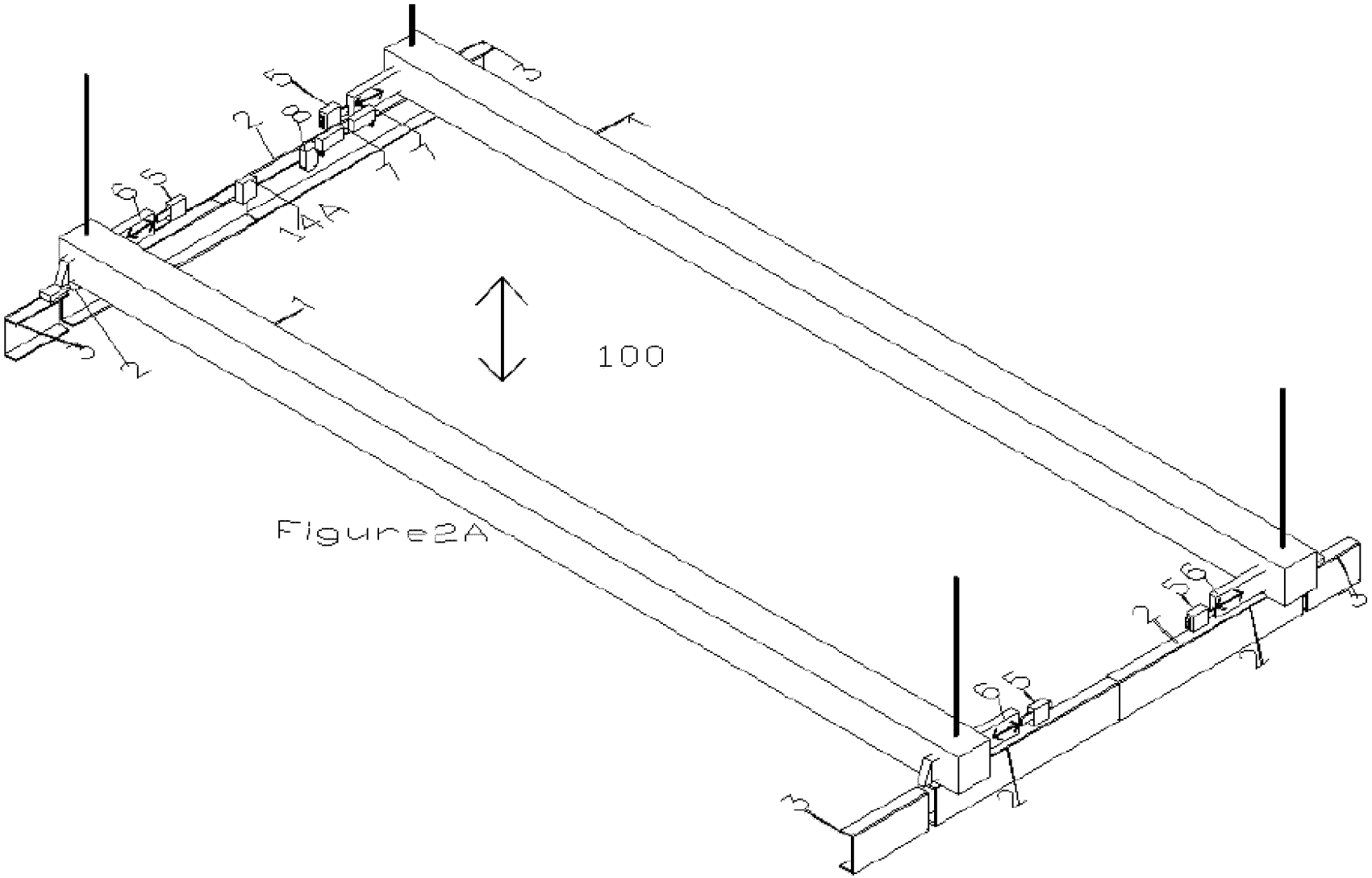
FIG. 2A is a perspective view of the vertical lift frame of FIG. 2.
Figures 1, 2A:
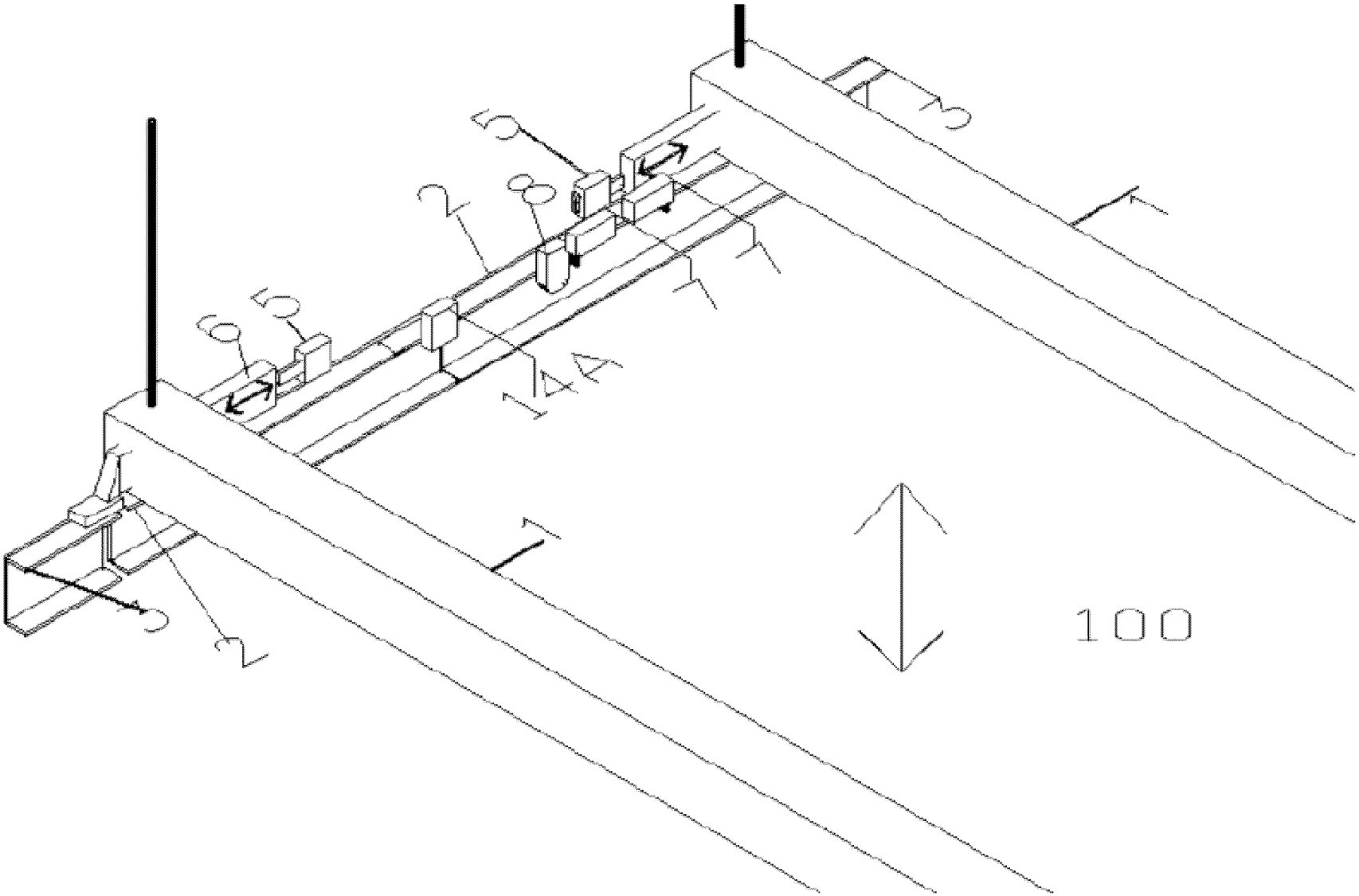
Figure 2B:
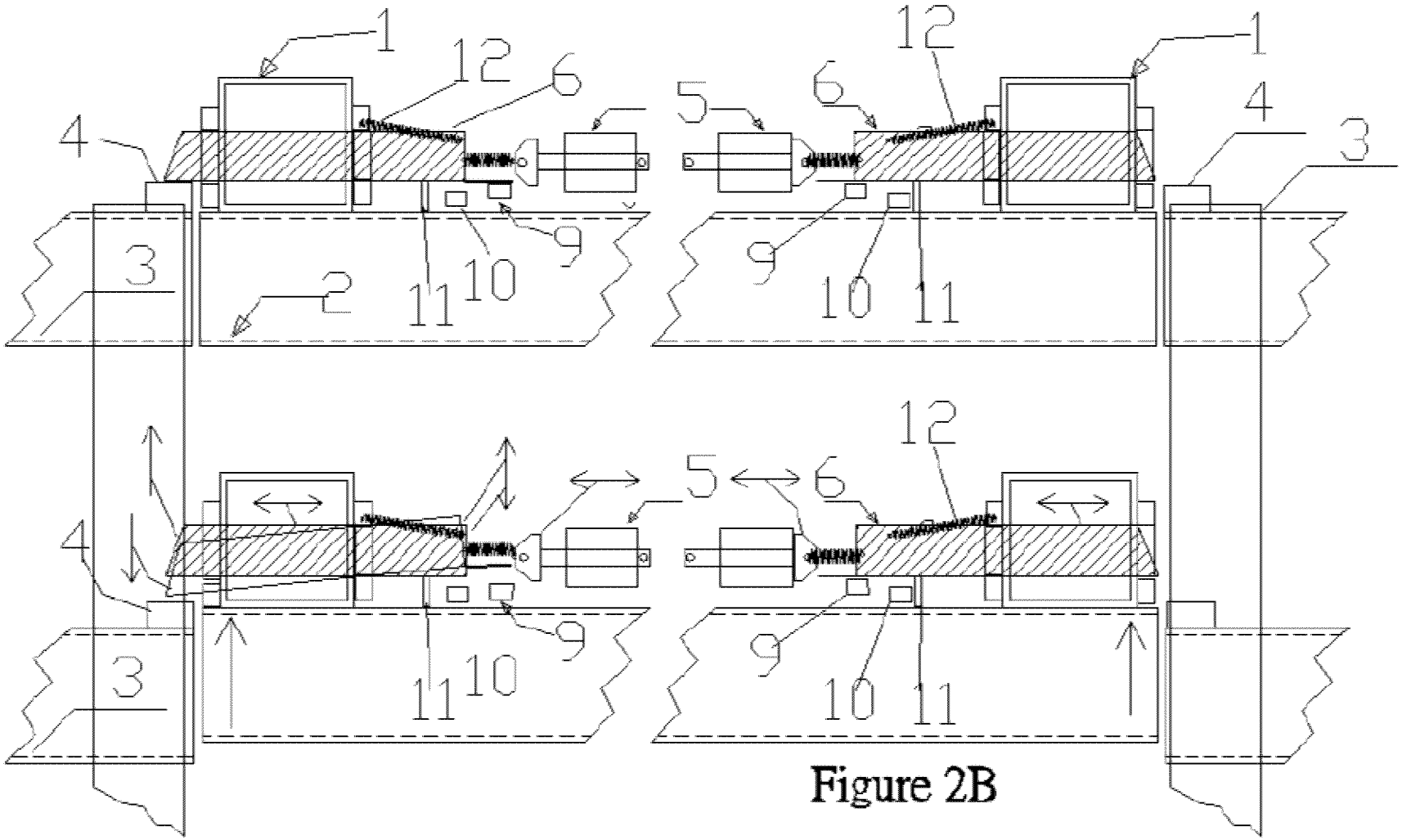
FIG. 2B is a front elevational view of the vertical lift frame of FIG. 2, illustrating operation of a pin system.
Figure 20:
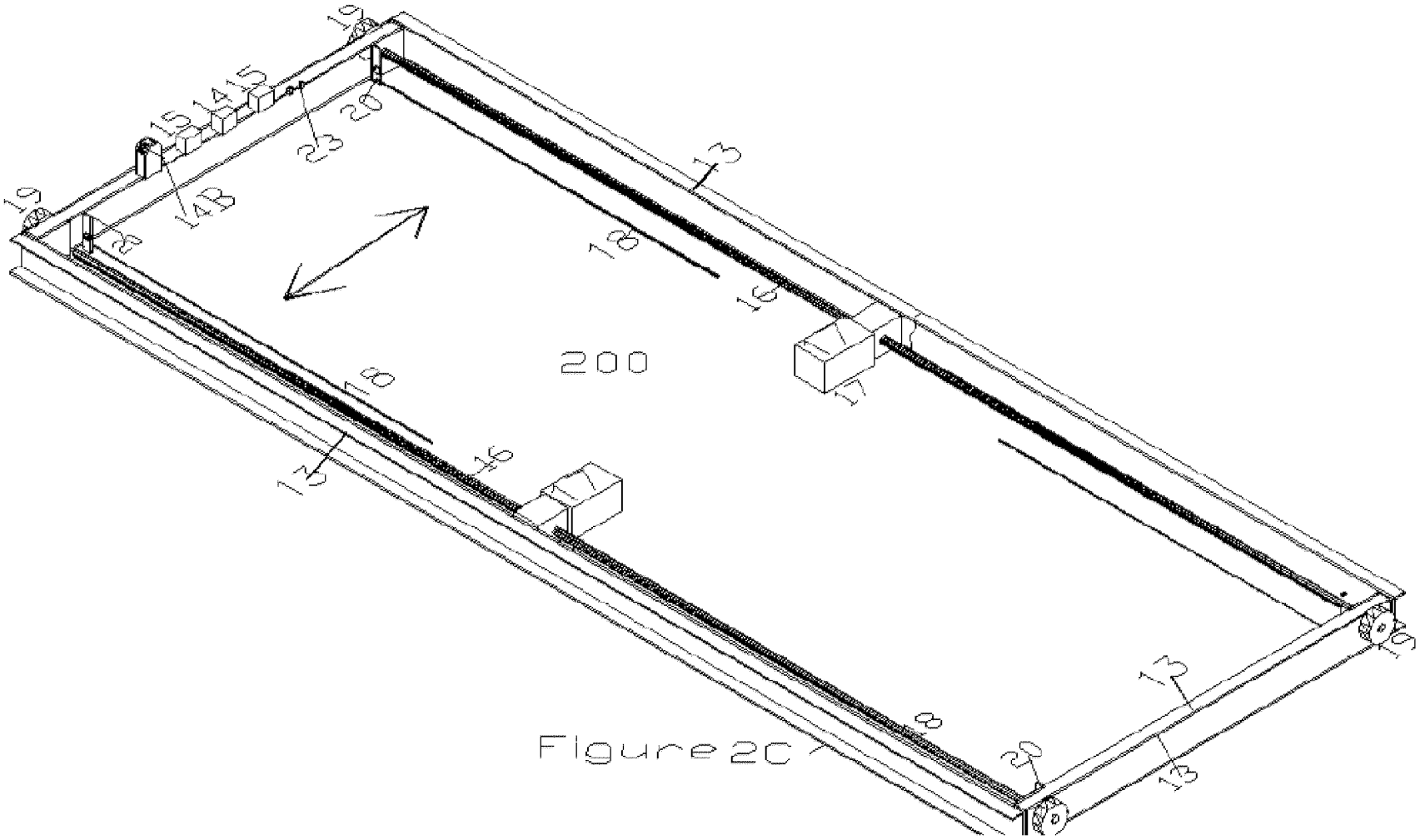

Referring to FIGS. 2A, 2A-1 and 2B, structures are provided in each parking spot for connection to the vertical lift frame 100. For example, each parking spot may have two fixed members 3. A vertical frame 100 may be anchored to the fixed members 3. The fixed members 3 each extend across the horizontal width of each parking spot, to enable horizontal movement of the horizontal slide frame 200 across the width of each parking spot, as explained further below. In some examples, the fixed member 3 may be a U-channel member. The fixed members 3 are positioned at a height along a top portion of each parking spot such that, when the vertical frame 100 is properly anchored to the fixed members 3, the wheels vehicle carried by the vertical frame 100 is close to the floor of the parking spot.

Mechanisms (described further below) are provided for detecting the position of the lift frame ends 2 relative to the fixed members 3. When the lift frame ends 2 and the fixed members 3 are detected to be substantially level, appropriate signaling may be communicated to the motor 49 to stop and lock, to hold the vertical lift frame 100 in position.

Anchoring means is provided to detachably anchor the vertical lift frame 100 to the multi-level parking tower, for example, by anchoring the vertical lift frame 100 to the fixed member 3. In the example shown, the anchoring means comprises a pin system. In some examples, a retractable pin 6 is provided close to each end of the lift frame ends 2. As shown in FIG. 2B, an opening is provided on the lift frame side 1 for each pin 6 to extend through to anchor to the multi-level parking tower. In some examples, an adjustable pad 4 is provided on the fixed member 3. Each adjustable pad 4 corresponds to a respective pin 6, and serves to support the pin 6 on the fixed member 3.

A biasing means is provided to push out and/or pull in the retractable pin 6. In an example, the biasing means includes a traction electromagnet 5 and coil spring 12 for each retractable pin 6.

The pin system may serve to ensure the lift frame end 2 is vertically level with the fixed member 3. Operation of the pin system is illustrated by the lower diagram in FIG. 2B. When the retractable pin 6 is retracted, the pin system is in the unanchored position. When the retractable pin 6 is extended, the pin system is in the anchored position. A proximity sensor 9 is positioned to sense the pin 6 when it is retracted. A signal from the proximity sensor 9 may be sent to a central controller (e.g., a central circuit or other controller unit) to indicate that the pin 6 is retracted and therefore the vertical lift frame 100 is not anchored and is free to move. One end of the retractable pin 6 is free to swing up and down. When unsupported on the fixed member 3, the end of the pin 6 swings down.

When the central controller decides that the vertical lift frame 100 is to stop at a certain level (e.g., to pick up or park a vehicle), the central controller sends signals to stop the motor 49. A signal is also sent to release the traction electromagnets 5 and the coil springs 12 to push the retractable pins 6 out through the frame sides 1. To ensure the vertical lift frame 100 is level with the fixed members 3 of the parking spot, further fine adjustments in the vertical position of the vertical lift frame 100 may be performed as described below.

When the ends 2 of the vertical lift frame 100 are substantially level with the fixed members 3 of the parking spot, the pin 6 rests on the adjustable pad 4 such that the orientation of the pin 6 is substantially horizontal (i.e., neither swinging up nor down). If the pin 6 is oriented swinging down (indicating the vertical lift frame 100 is too high) or swinging up (indicating the vertical lift frame 100 is too low), this is detected by an orientation sensing unit, which includes a proximity sensor 10 in cooperation with a plate 11 attached to the pin 6. The proximity sensor 10 sends a signal to the central controller, and the central controller causes the motor 49 to adjust the vertical position of the vertical lift frame 100, as appropriate, until the pin 6 is substantially horizontal (as indicated by the absence of a signal from the proximity sensor 10).

In some examples, the above-described arrangement enables the vertical lift frame 100 to be vertically positioned with an accuracy of within +/−0.5 mm (vertically) of the fixed members 3. Notably, when the lift frame ends 2 and fixed members 3 are U-channel members, a substantially continuous U-channel is formed along the lift frame ends 2 and the fixed members 3. This helps to ensure a smooth horizontal movement of the horizontal slide frame 200 from the vertical lift frame 100 to the parking spot. Although described using a pin system with proximity sensors 9, 10 other position sensors (e.g., optical sensors or contact switches) may be suitable for sensing the vertical position of the vertical lift frame 100.

Figures 1, 2C:
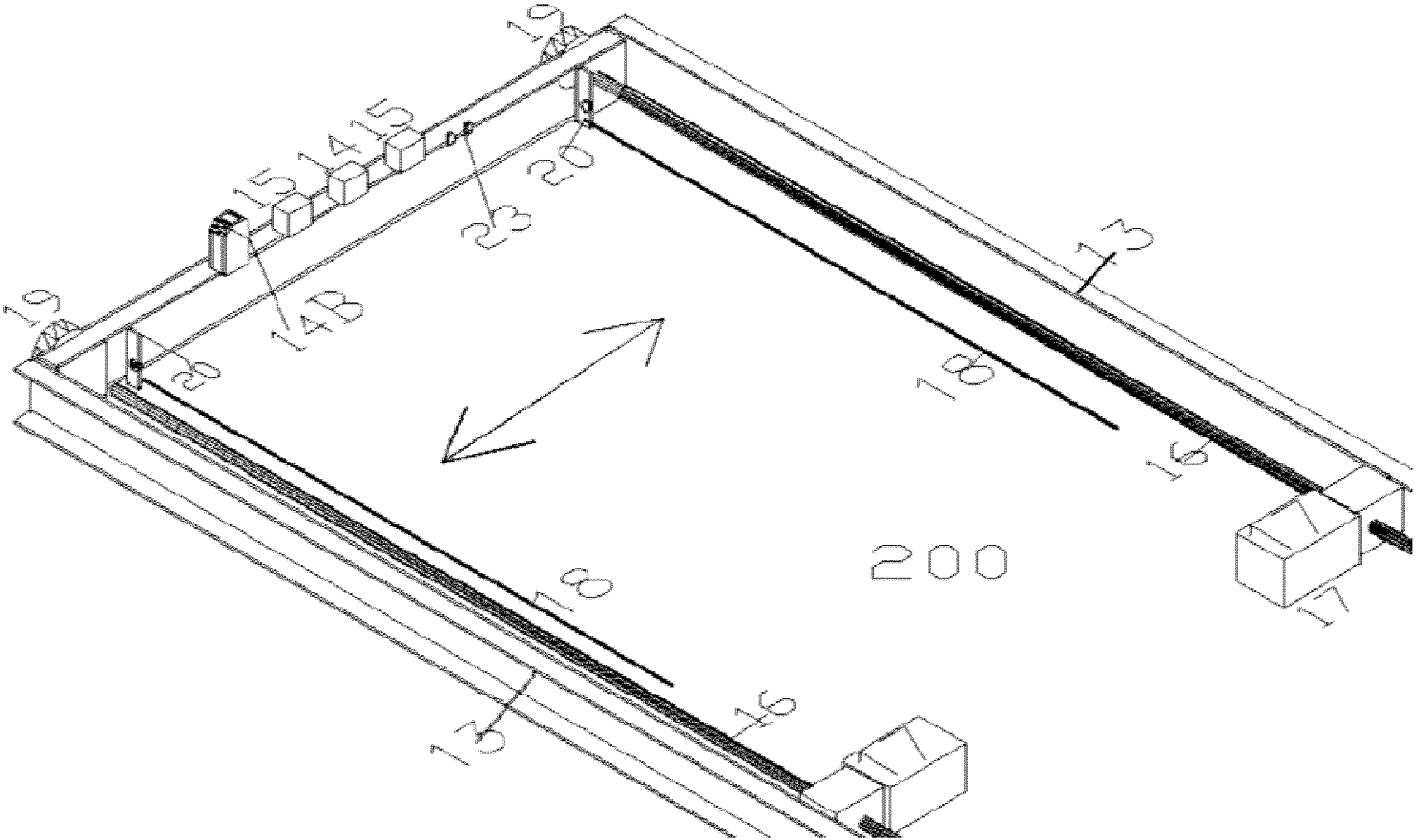
FIG. 2C is a perspective view of the horizontal slide frame of FIG. 2.
Figures 2, 2C:
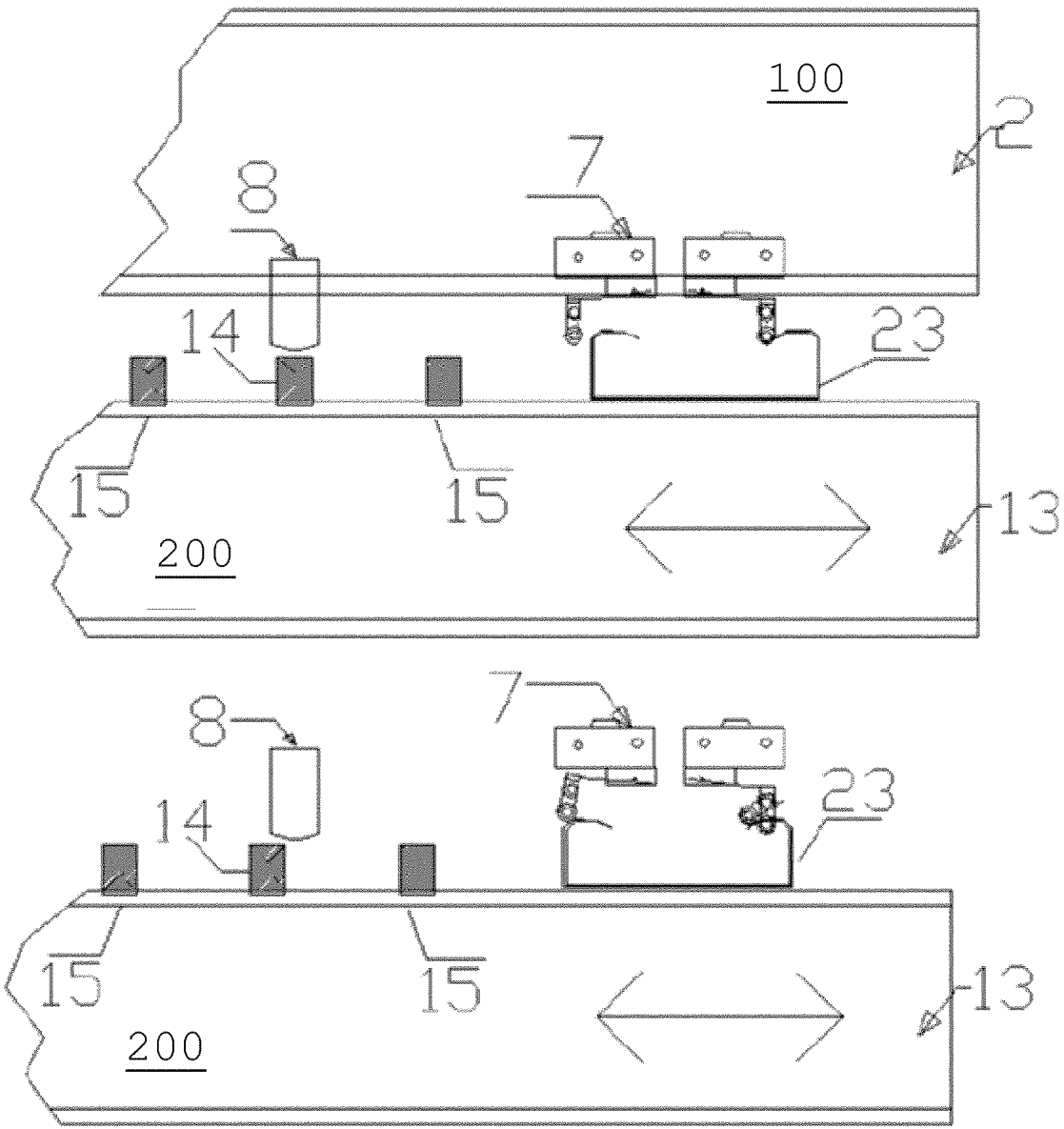

Reference is now made to FIGS. 2C and 2C-1. The horizontal slide frame 200 includes two opposing longitudinal sides 13 and two opposing ends 201. The sides 13 and the ends 201 define a substantially rectangular horizontal slide frame 200. In some examples, the longitudinal sides 13 and the two opposing ends 201 are both U-channel shaped.

Means are provided on the horizontal slide frame 200 for the frame 200 to move horizontally. In some examples, a motor 17 is provided on each longitudinal side 13, each motor 17 driving a respective shaft 16, which may be made of steel. The shaft 16 extends through the ends 201. A wheel 19 is disposed on each end of the shaft 16 on the exterior of the horizontal slide frame 100, and driven by the shaft 16. The shafts 16 may be wheel shafts. In some examples, the motors 17 are geared brake motors. Bearing housings may be provided on the shafts 16 to help ensure smooth movement. For example, two bearing housings are provided at each corner of the horizontal slide frame 200.

In an example, each end 2 of the vertical lift frame 100 has a rail which can accept the wheels 19 on the horizontal slide frame 200. For example, the end 2 may be transverse U-channel members in which the wheels 19 may slide. The motors 17 may then drive the wheels 19 so that the horizontal slide frame 200 may slide horizontally relative to the vertical lift frame 100.

Figure 2D:
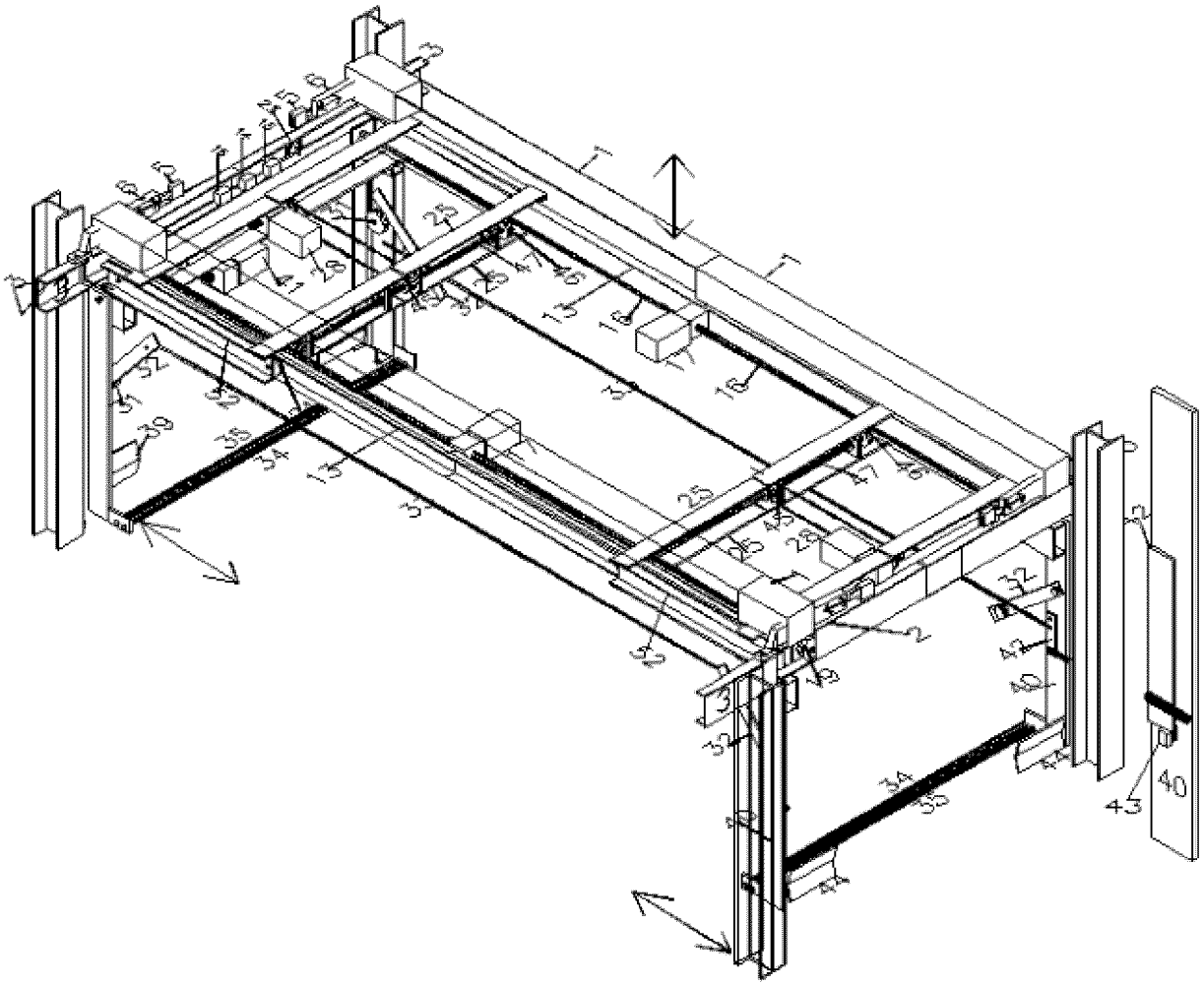
FIG. 2D is a perspective view of the vertical lift frame with the horizontal slide frame and the sliding wheel gripper assembled.

As shown in FIG. 2D, when the vertical lift frame 100 is anchored to the fixed members 3, and where the fixed members 3 and the lift ends 2 have U-channel configurations, the wheels 19 may also slide along the lift ends 2 and onto the fixed members 3 in each of the parking spots so that the horizontal slide frame 200 may move into and out of the parking spots substantially horizontally.

Means are also provided on the horizontal slide frame 200 to detect its position relative to the vertical lift frame 100, as illustrated in FIG. 2C-2. In some examples, a sensing unit 14 (e.g., a proximity eye sensor) is provided on at least one end 201 of the horizontal slide frame 200. The sensing unit 14 cooperates with a detection plate 8 provided on a corresponding end 2 of the vertical lift frame 100 to detect that the center of the horizontal slide frame ends 201 is aligned with the center of the vertical lift frame ends 2. For example, the sensing unit 14 on the horizontal slide frame 200 may be located on the end 201 such that the sensing unit 14 matches up with the detection plate 8 on the vertical lift frame 100 when the center of the ends 201 is aligned with the center of the lift frame ends 2. When proper alignment is detected, the sensing unit 14 will then send a signal to the central controller that in turn instructs the motors 17 to stop and lock. When thus aligned, the horizontal slide frame 200 is in the middle of the passageway A7, such that vertical movement of the vertical lift frame 100 is not impeded.

One or more additional auxiliary sensing units 15 (e.g., proximity sensors) may also be provided on the horizontal slide frame 200, on either side of the sensing unit 14. When an auxiliary sensing unit 15 is matched up with the detection plate 8 the auxiliary sensing unit 15 sends a signal to the central controller. A signal from the auxiliary sensing unit 15 indicates that the horizontal slide frame 200 is almost aligned with the vertical lift frame 100. The central controller controls the motors 17 to decelerate, thus helping to ensure a smooth deceleration and stop of the horizontal slide frame 200.

Other position sensors (e.g., contact switches or optical sensors) may be used to sense the position of the horizontal slide frame 200 relative to the vertical lift frame 100.

Fallback means 23 may also be provided on the horizontal slide frame 200, as a fallback in the event the sensing unit 14 fails. In some examples, the fallback means 23 is in the form of a pair of leaf springs that cooperate with mechanical one-way limit switches 7 (see FIG. 2B) provided at a corresponding position on the vertical lift frame 100. The fallback means 23 and switches 7 are positioned such that the switches 7 are triggered by horizontal movement of the horizontal slide frame 200 relative to the vertical lift frame 100. Signals from the switches 7 are sent to the central controller. Based on the signals from the switches 7, the central controller is able to detect if the horizontal slide frame 200 is misaligned. In case the sensing unit 14 fails, the fallback means 23 ensures safe operation of the system by ensuring that the horizontal slide frame 200 is not extended out from the vertical lift frame 100 when initiating vertical movement in the passageway A7.

A detection plate 14B is also provided on the horizontal slide frame 200 (shown next to the sensing unit 15 in FIGS. 2C and 2C-1). The detection plate 14B cooperates with a sensing unit 14A (see FIGS. 2A and 2A-1) provided at a corresponding location on the vertical lift frame 100. For example, the sensing unit 14A may be a proximity sensor that sends a signal when the detection plate 14B is detected in the vicinity. The sensing unit 14A detects when the horizontal slide frame 200 is aligned with the vertical lift frame 100. For example, the sensing unit 14A may be provided on the end 2 of the vertical lift frame 100 such that the sensing unit 14A is aligned with the detection plate 14B on the end 201 of the horizontal slide frame 200 when the center of the end 201 is aligned with the center of the lift frame end 2. When thus aligned, the horizontal slide frame 200 is in the middle of the passageway A7, such that vertical movement of the vertical lift frame 100 is not impeded. When proper alignment is detected, the sensing unit 14A sends a signal to the central controller. The central controller may then instruct the motor 49 to raise or lower the vertical lift frame 100.

Reference is now made to FIG. 2D, which shows the vertical lift frame 100, horizontal slide frame 200 and the sliding wheel gripper 300 assembled. The horizontal slide frame 200 horizontally slides with respect to the vertical lift frame 100 (e.g., by sliding movement of the wheels 19 along the lift ends 2).

Cables 18 are provided on the horizontal slide frame 200 for moving the sliding wheel gripper 300 longitudinally along the horizontal slide frame 200. One end of each cable 18 is fixed to the ends 201 of the horizontal slide frame 200.

Figure 3A:
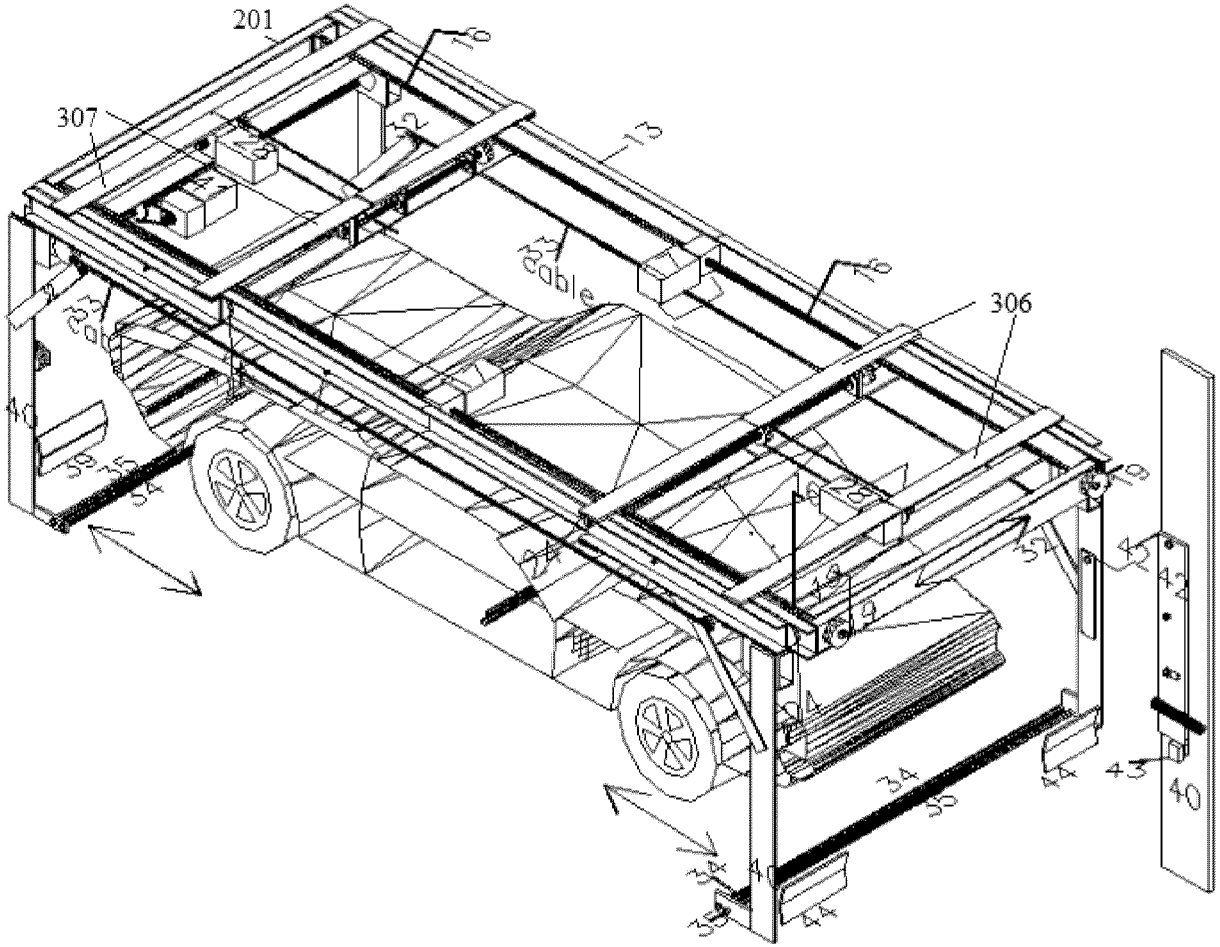
FIG. 3A is a perspective view of the sliding wheel gripper installed inside the horizontal slide frame with a vehicle in a released position.
Figure 3B:
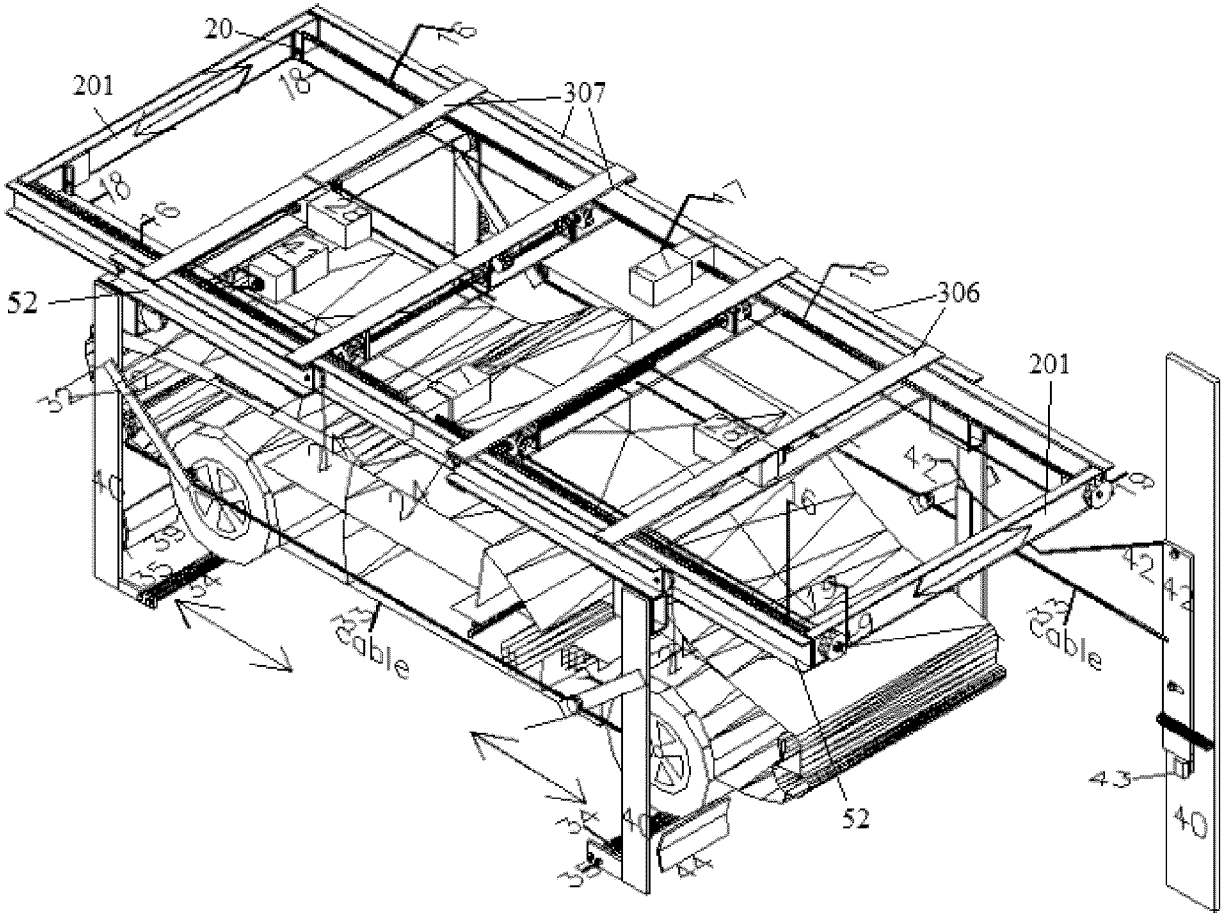
FIG. 3B is a perspective view of the sliding wheel gripper installed inside the horizontal slide frame with a vehicle in a gripped position.

Reference is now made to FIGS. 3A and 3B. The sliding wheel gripper 300 can be secured to the horizontal slide frame 200. For example, the sliding wheel gripper 300 may have top frames 306 and 307 that movably attach to the horizontal slide frame 200 via the cables 18. It is understood that the attachment may be by any suitable means. In some examples, the sliding wheel gripper 300 may be part of the horizontal slide frame 200. For example, the horizontal slide frame 200 may form the top frame of the sliding wheel gripper 300.

In some examples, the top frames 306 and 307 are disposed on top of and longitudinally slide relative to the horizontal slide frame 200. Means are provided so that top frames 306 and 307 may move smoothly along the length of the horizontal slide frame 200. For example, wheels 24 may be provided on the bottom of the top frames 306 and 307. The longitudinal sides 13 of the horizontal slide frame 200 may be configured with channels to receive the wheels 24, to allow the wheels 24 to move along the channels. In some examples, two wheels 24 are provided on each side of each of the top frames 306 and 307 along the length of the horizontal slide frame 200. It is understood that any other suitable means may be used.

The wheels 24 may be installed on the top frames 306 and 307 by any suitable means. In some examples, the top frames 306 and 307 may have frames 52 extending downwardly from the top of the top frames 306 and 307 and the wheels 24 are installed on the frames 52. The frames 52 may be made of steel.

The longitudinal movement of the sliding wheel gripper 300 involves movement of the top frames 306, 307 towards and away from each other. This movement may be driven by two cable systems, as described further below.

When the top frames 306 and 307 are installed over the top of the horizontal slide frame 200, the horizontal slide frame 200 and the vertical lift frame 100 is configured so that there is sufficient room between the longitudinal sides 13 of the horizontal slide frame and the longitudinal lift frame sides 1 to accommodate the top frames 306 and 307.

The sliding wheel gripper 300 includes two portions 301 and 302. Each portion 301, 302 has a respective set of arms 40 extending substantially downwardly from the top frame 306 and 307, respectively. The arms 40 can move toward and away from each other. The two arms 40 may be driven by any suitable means known in the field. For example, the two arms 40 may be driven by cable, chain, pneumatic cylinder, hydraulic cylinder or any suitable mechanical device. For example, two cable systems, described further below, may be used to drive the arms 40 towards and away from each other. Each arm 40 has two sides defining a space therebetween to allow the arms 40 to move close to the wheels of a vehicle.

In some examples, the arms 40 are connected to the top frames 306 and 307 so that when the top frames 306 and 307 move, the arms 40 move. The connection is preferably rigid. In some examples, the arms 40 are connected to the top frames 306 and 307 through joint plates. In some examples, two joint plates are used to connect each side of each of the arms 40 to the frame respective top frame 306, 307.

Movement of the arms 40 may be driven by any suitable means. In some examples, movement of the arms 40 towards each other may be driven by one system (e.g., a first cable system) while movement of the arms 40 away from each other may be driver by another system (e.g., a second cable system). The use of two separate systems to drive the arms 40 may provide a failsafe mechanism such that, in the event of power failure or other system failure, the arms 40 will not inadvertently release a gripped vehicle.

In the example disclosed herein, a first cable system includes cables 18 that can be retracted by respective motors 28. Each cable 18 has one end fixedly attached to a respective end 201 of the horizontal slide frame 200, wraps around a respective one of the top frames 306, 307, and has another end retractable by the motor 28. Thus, the motors 28 can drive the top frames 306 and 307 toward the ends 201 of the horizontal slide frame 200 by retracting the cables 18. This effects movement of the arms 40 away from each other to a release position.

Figure 4:
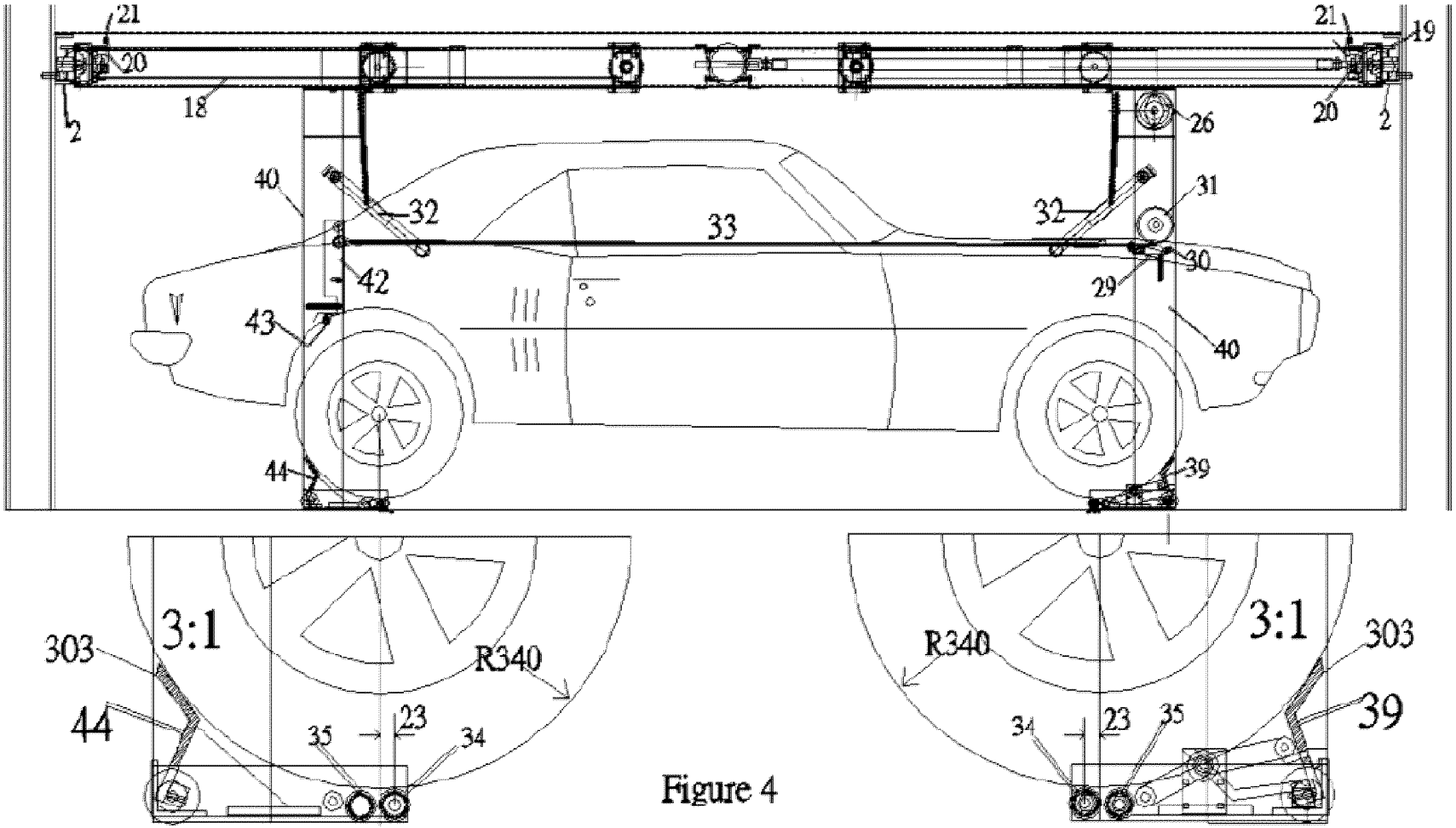
FIG. 4 is a side elevational view of a vehicle gripped by the sliding wheel gripper of FIG. 2, and an enlarged view of the front and back wheels of the vehicle being gripped.
Figure 4A:
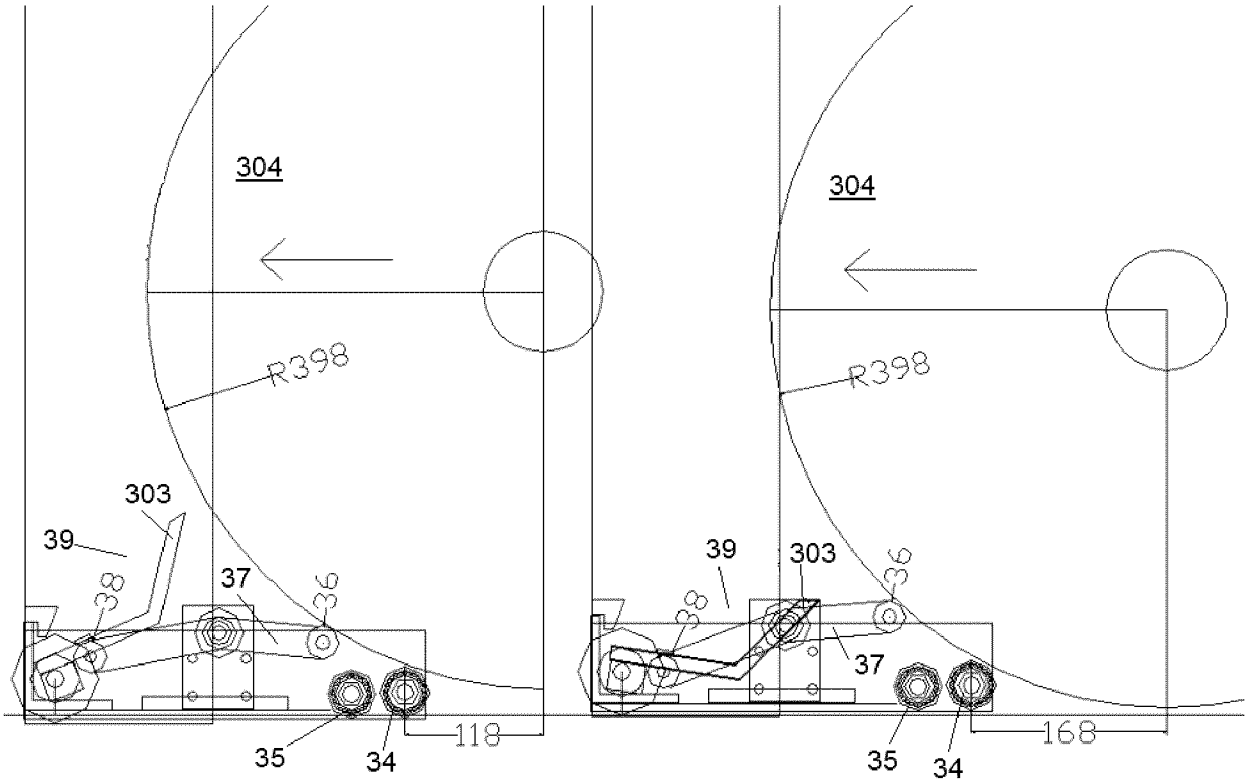
FIGS. 4A and 4B shows enlarged side elevational view illustrating operation of a gripping device to grip a wheel.
Figure 4B:
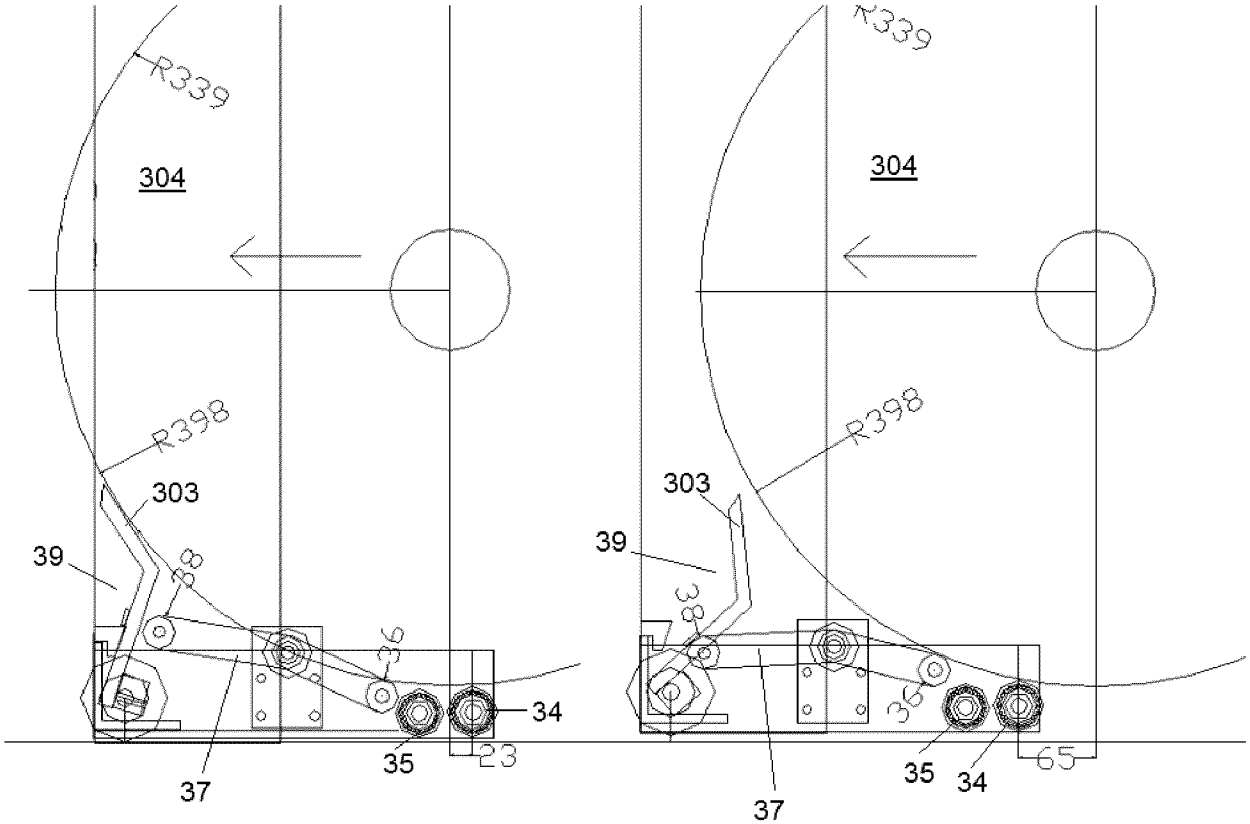
Figure 4C:
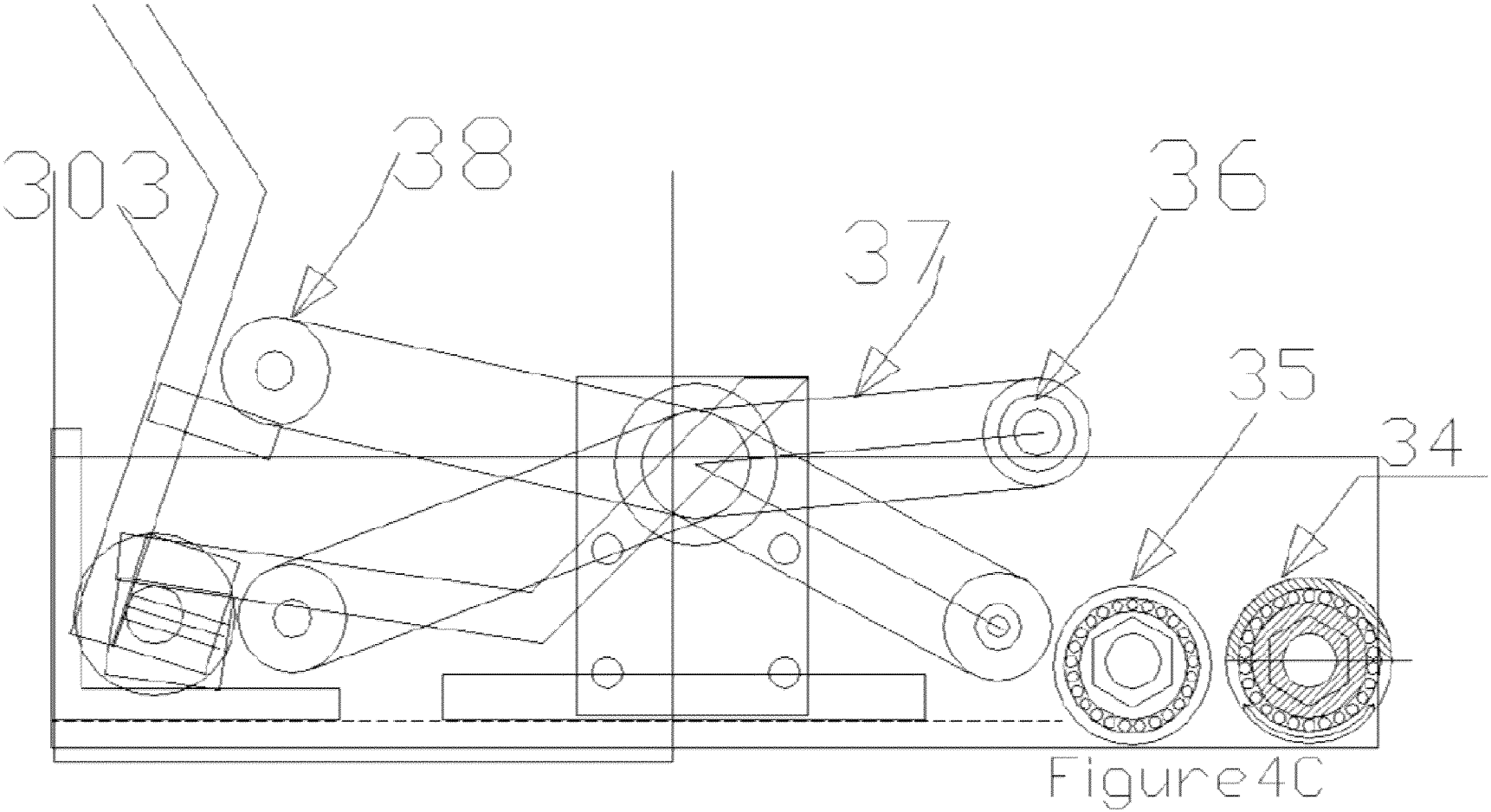
FIG. 4C is an enlarged view of the gripping device, illustrating operation of a rocker arm.

A second cable system includes cables 33 that can be retracted by a motor 41. For example, there is a cable 33 along each longitudinal side of the sliding wheel gripper 300. Each cable 33 has one end fixed to one arm 40 extending from one top frame 306, runs through a wheel 31 (see FIG. 4) on another arm 40 extending from the other top frame 307, and has another end retractable by the motor 41. Thus, the motor 41 can drive the arms 40 towards each other, to a gripping position, by retracting the cables 33.

In some embodiments, cable tension sensor arms 20 are provided to detect the tension in the cables 18. When the tension in the cables 18 reaches a threshold amount, this indicates that the top frames 306, 307 are fully separated. When the tension is at the threshold amount, a signal is sent to stop and lock the motors 28.

In operation, the sliding wheel gripper 300 is initially in a release position (see FIG. 3A) in which the top frames 306, 307 and the arms 40 are at opposite longitudinal ends of the horizontal slide frame 200. The cable 33 is also in a raised position. When a vehicle is to be gripped by the sliding wheel gripper 300, the central controller controls the motor 41 to retract the cables 33, causing the arms 40 to move towards each other so that the sliding wheel gripper 300 is in the gripping position to grip the vehicle.

The two cable systems operate opposite to each other, to coordinate movement of the top frames 306, 307 and the arms 40. Specifically, the motors 28 tighten the cables 18 to cause the top frames 306, 307 to move apart, while simultaneously the motor 41 releases the cables 33 to enable the arms 40 to move apart, to bring the sliding wheel gripper 300 into the release position in which a vehicle is released from the sliding wheel gripper 300. To bring the sliding wheel gripper 30 into the gripping position in which a vehicle is gripped, the motor 41 tightens the cables 33 to drive the arms 40 of the sliding wheel gripper 300 towards each other, to grip the wheels 304 and 305, while simultaneously the motors 28 release the cables 18 to enable the top frames 306, 307 to move towards each other.

As shown in FIGS. 3A and 3B, the cables 33 are raised when the sliding wheel gripper 300 is in the release position. This allows unimpeded horizontal movement of the horizontal slide frame 200. As the cables 33 are retracted by the motor 41, rocker arms 32 (see FIG. 4H) provided on the arms 44 arm lowered by the tightening of the cables 33, to enable the cables 33 to be lowered, so that the cables 33 may more effectively move the arms 40 towards each other.

In some examples, retracting cable wheels 26 are provided to assist with retracting the cable 33 when the cable 33 is raised. In some examples, one pair of retractable cable wheel 26 is provided at one pair of arms 40 on one end of the sliding wheel gripper 300 (e.g., the arms 40 positioned near the front of the vehicle, in the example shown in FIG. 4). In some embodiments, a bearing housing 27 is provided, for smoother motion.

Referring to FIGS. 4, 4A, 4B, 4C, and 4D, each arm 40 has a respective device 39, 44 for gripping a respective vehicle wheel 304, 305 close to the bottom of the arm 40. When the motor 41 retracts the cable 33, the vehicle wheels 304, 305 are eventually grasped by devices 39 and 44. The motor 41 may be a geared brake motor.

The gripping devices 39 and 44 of the sliding wheel gripper 300 each includes rotary shafts 34 and 35. The gripping device 39 is substantially identical to the device 44 except for the orientation. For simplicity, description referring to one gripping device 39 similarly applies to the other gripping device 40, and vice versa.

By drawing the cable 33 using the motor 41, the portions 302, 301 of the sliding wheel gripper 300 moves towards each other, closer to the wheels of the vehicle 304 and 305. When the cable 33 continues to tighten, the rotary shafts 34 and 35 push below the wheels 304 and 305 until the rotary shafts 34 and 35 are on either sides of the vertical center lines of the wheels 304 and 305. This way, the vehicle wheels 304 and 305 sit above the rotary shafts 34 and 35. In some examples, the rotary shafts 34, 35 are positioned such that the center of the rotary shaft 34 is at a distance of around 25 mm, for example 23 mm, offset from the centerline of the vehicle wheel 304, 305 when properly positioned.

In some examples, each rotary shaft 34 or 35 comprises a shaft, a needle bearing and a pipe. The shaft and the pipe may be made of steel.

The gripping devices 39 and 44 also include wheel stoppers 303, which lift up and press against the surfaces of the wheels 304 and 305. The stopper 303 may be biased by any suitable means to press against the wheels 304 and 305. In some examples, the device 39 includes a rocker arm 37, which has rolling wheels 36 and 38 disposed on the two ends of the rocker arm 37. When the wheel 304 touches the distal rolling wheel 36 of the rocker arm 37, the pressure of the wheel 304 against the rolling wheel 36 is transmitted through the rocker arm 37 to the proximal wheel 38 to lift the wheel stopper 303. The rocker arm 37 may be a ratio rocker arm that lifts the wheel stopper 303 to be about 8 inches high when fully lifted. For example, the height of the device 39 may be about 4 inches when the stopper 303 is in standby position (i.e., unlifted position). Thus, when the stopper 303 is in the standby position, the device 39 can pass under the vehicle bumper before it is raised to grip and secure the wheel 304. In some examples, the stopper 303 provided on one of the gripping devices 39, 44 may be fixed in the lifted position, instead of being movable between lifted and unlifted positions. For example, if the gripping device 44 is intended to grip a back wheel of a vehicle, the stopper 303 of the gripping device 44 may be fixed in the lifted position, because the back of the vehicle is typically higher than the front of the vehicle and thus the stopper 303 does not need to be in the unlifted position to fit under the vehicle.

The sliding wheel gripper 300 may be provided with a sensing unit to avoid excessive gripping force on the vehicle wheels. In some examples, the sensing unit is an adjustable cable tension swing arm 42. Details of the cable tension swing arm 42 are shown in FIGS. 4G and 4H.

In an example of the adjustable cable tension swing arm 42, the adjustable cable tension swing arm 42 comprises swing arm pin 42A, cable tension pin 42B, tension spring pin 42C, spring 42D, and flat steel sheet 42E. The flat sheet 42E may be made of steel.

The cable tension swing arm 42 is connected to the cable 33 at the cable tension pin 42B. The cable tension swing arm 42 is able to swing on the swing arm pin 42A. The spring 42D is connected to the tension swing arm 42 at the tension spring pin 42C and biases the cable tension swing arm 42 away from a proximity sensor 43.

When tension in the cable 33 is at or above a threshold value, the cable tension swing arm 42 is pulled by the tension in the cable 33 to come into proximity of the proximity sensor 43. When the tension in the cable 33 reaches the threshold value, this indicates that the sliding wheel gripper 300 has gripped the wheels of the vehicle a sufficient amount. The sensor 43 sends a signal to the central controller that in turn causes the motor 41 to stop and lock. Thus, the vehicle is gripped by the sliding wheel gripper 300.

Distance between the swing arm pin 42A and the cable tension pin 42B is shorter than the distance between the tension spring pin 42C and the swing arm pin 42A. For example, the distance from the tension spring pin 42C to the swing arm pin 42A is 5 times longer than from the cable tension pin 42B to the swing pin 42A. The threshold tension value may be adjusted by adjusting the biasing force of the spring 42D, to obtain a desired gripping force. Other sensors (e.g., a piezoelectric sensor or force sensor) may be used to sense when the wheels 304, 305 are sufficiently gripped.

To release the vehicle from the sliding wheel gripper 300, a signal is sent to the motor 41 to initiate the extension of the cable 33 and to motors 28 to tighten the cables 18 in order to drive the top frames 306 and 307 away from each other, thus moving the arms 40 of the sliding wheel gripper 300 away from the wheels 304 and 305. The rocker arms 32 are biased to push the cable 33 up above the vehicle. The vehicle is then released from the devices 39 and 44, and securely lands.

Figure 4D:
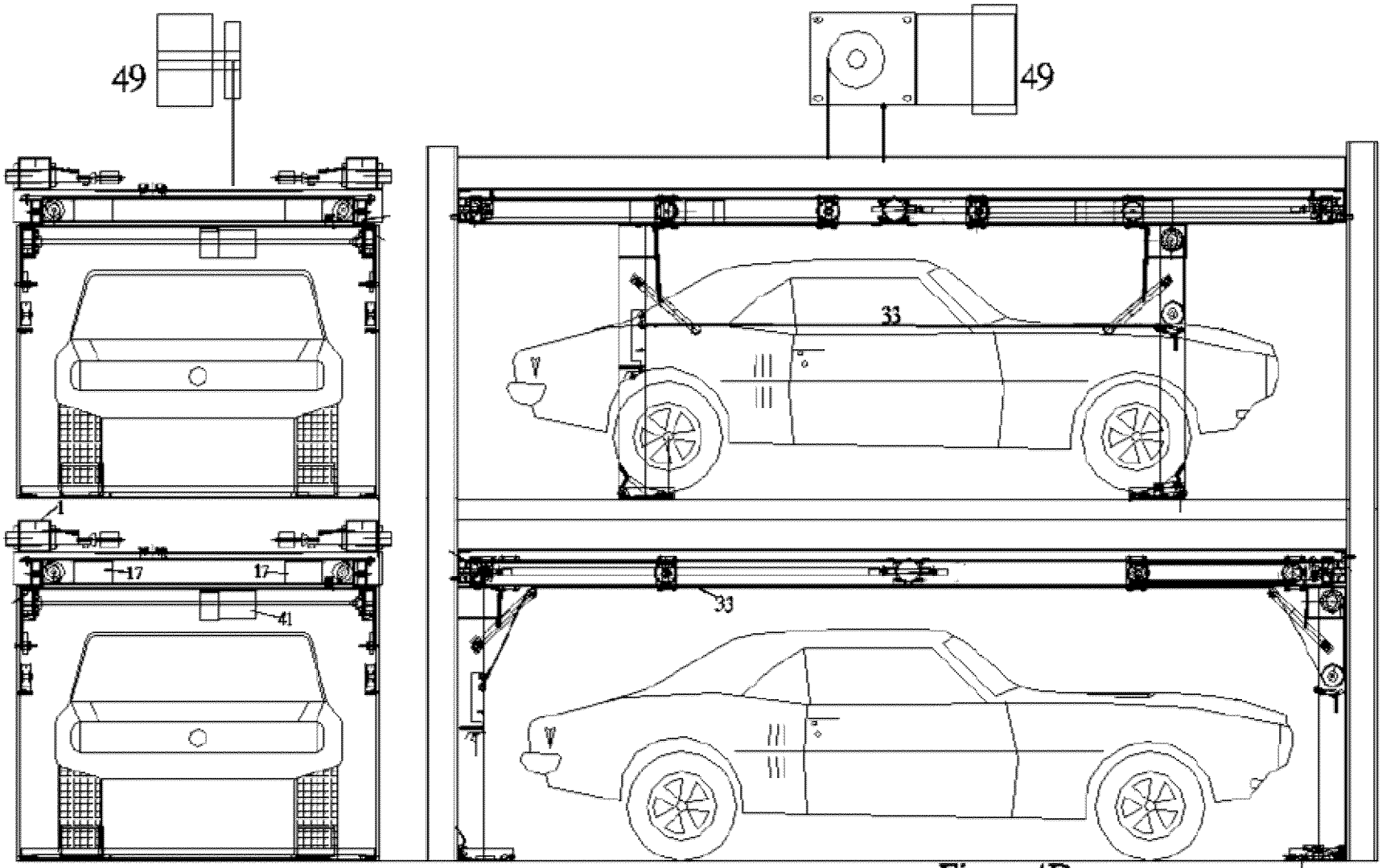
FIG. 4D is a side elevational view and front elevational view of the sliding wheel gripper of FIG. 4, with a car gripped and released.

The motors 28 continue to tighten the cable 18 so that the top frames 306 and 307 are moved fully away from each other so that the sliding wheel gripper 300 is fully retracted to an open position as shown by the lower vehicle in FIG. 4D. The motors 28 then stop and lock when the top frames 306, 307 are sufficiently apart (e.g., as sensed by cable tension sensor arms 20 described above.

Figure 4E:
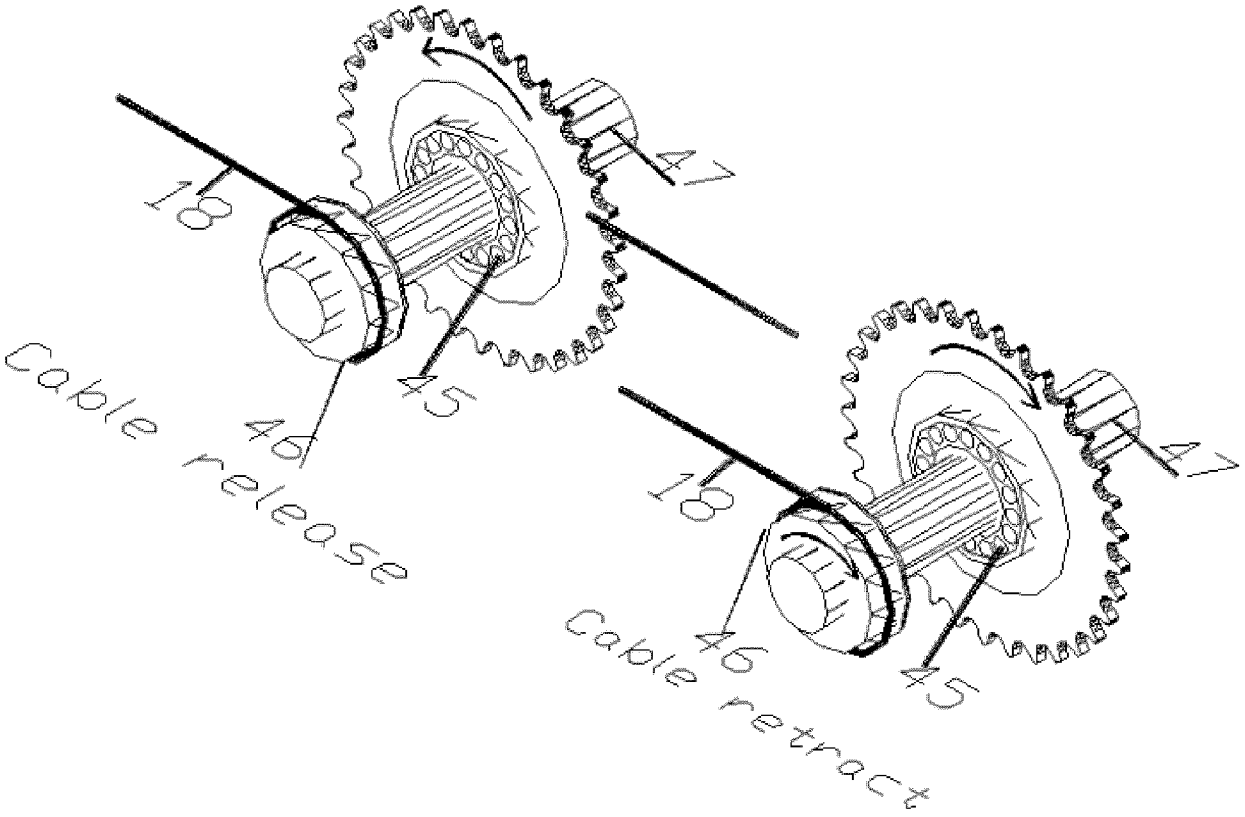
FIG. 4E is an enlarged perspective view of the mechanism for tightening and loosening a cable.
Figure 4F:
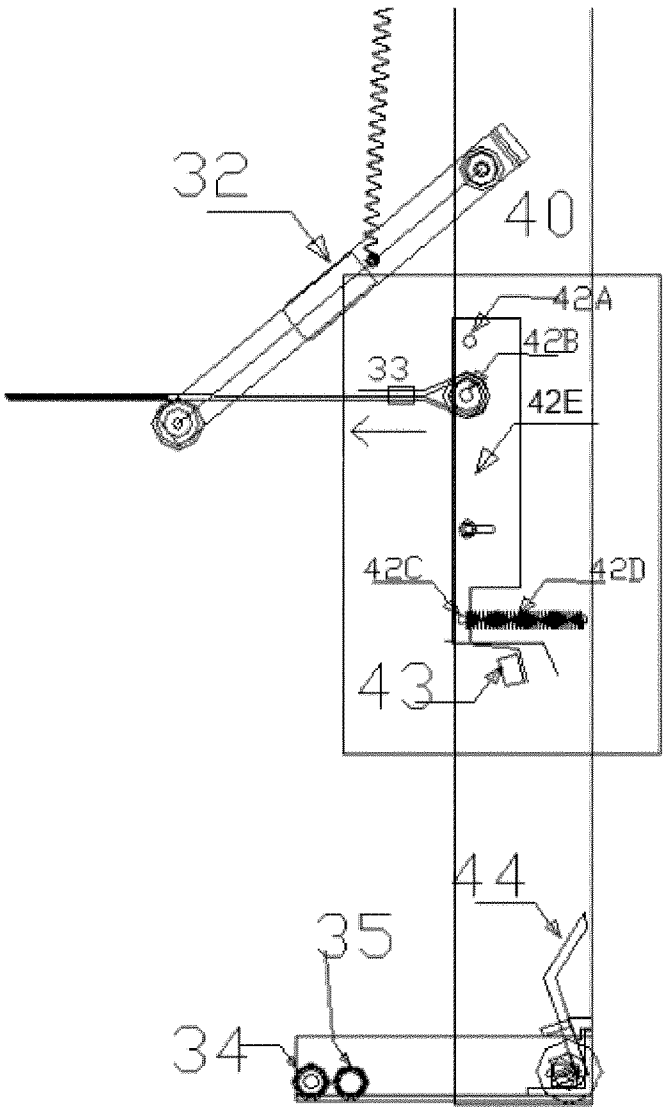
FIGS. 4F and 4G are side elevational views of an embodiment of an adjustable cable tension swing arm.
Figure 4G:
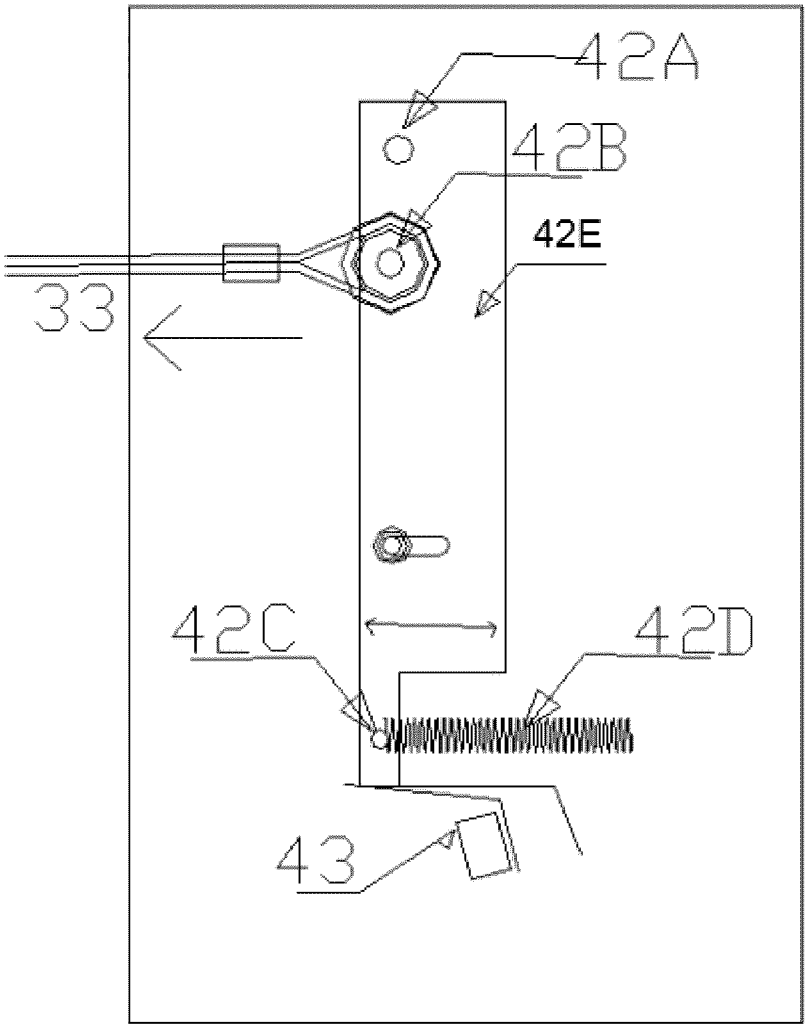
Figure 4H:
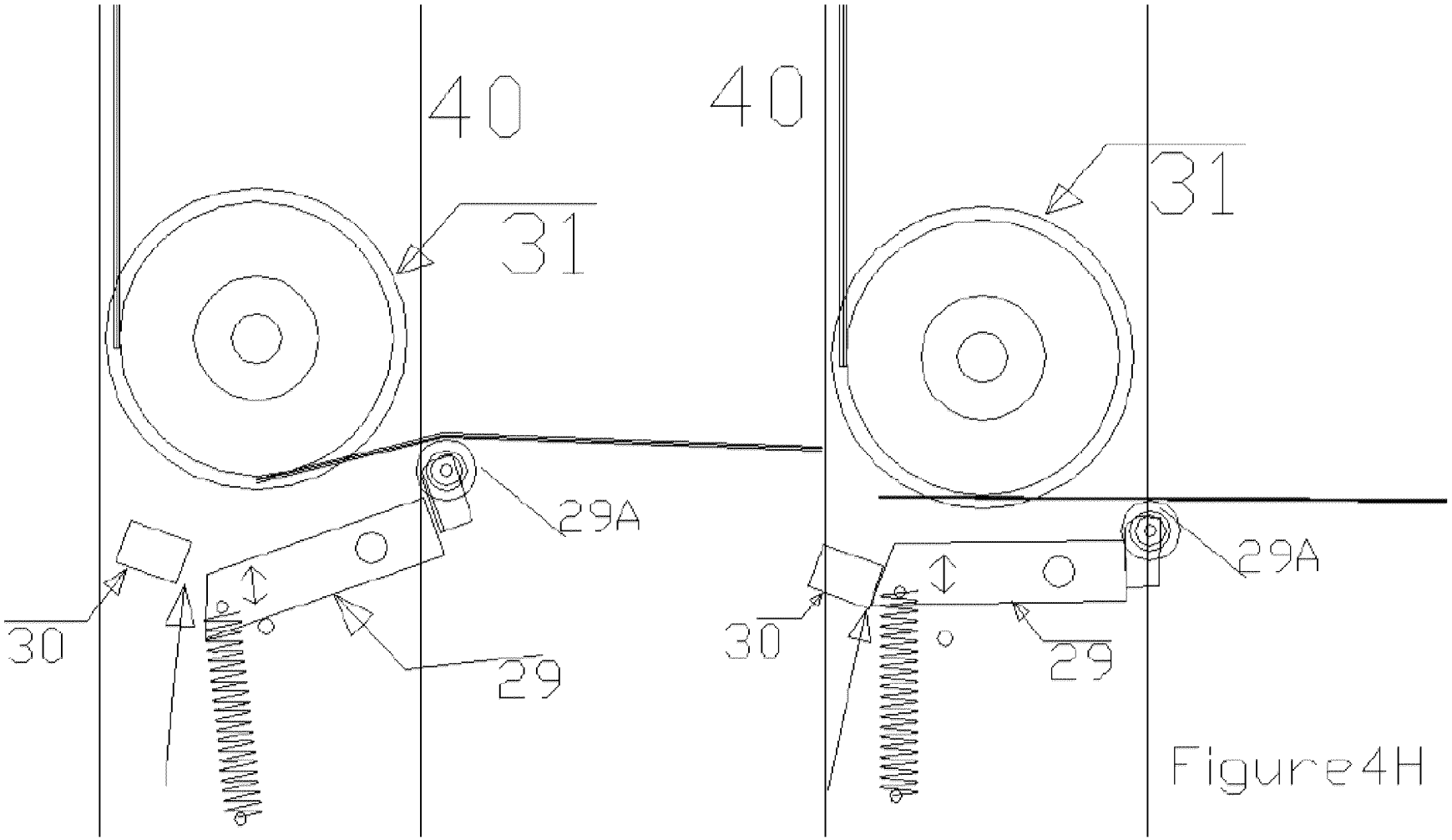
FIG. 4H is an enlarged side perspective view illustrating operation of an embodiment of a cable rocker arm.

It is understood that the motors 28 and 41 may drive the cables 18 and 33, respectively, by any suitable means. In some examples, as shown in FIG. 4E, the cable 18 is driven by a cable retractable device comprising one way bearing 45, sprocket, shaft 47 and wheel 46. The shaft 47 may be made of steel. The cable retractable device is driven by the shaft 47 through the one way bearing 45 installed inside the sprocket. The shaft 47 is in turn driven by the motor 28. The wheel 46 is driven by cable 18. In some examples, two cable retractable devices are installed on the sliding wheel gripper 300 to control respective gripper arms 40 by retracting or releasing of the cable 18. When the motor 28 is stopped, rotation of the output shaft 47 will be extremely heavy. When motor 41 drives the cable 33 to cause gripping of the wheels 304, 305, motor 28 must rotate faster than motor 41. Since the one way bearing is in reverse direction without a driving force, the cable driven wheel 46 is at standstill. When the gripper arms 40 approach the wheels and pull the cable 18, the cable driven wheel 46 then can be easily pulled to release the cable. On the contrary, when motor 41 rapidly releases the cable 33, motor 28 slowly pulls the cable 18 in order to cope with the releasing speed of the cable 33. In this way, the vehicle wheels 304, 305 are gently released to avoid rapidly dropping the vehicle.

Figure 4I:
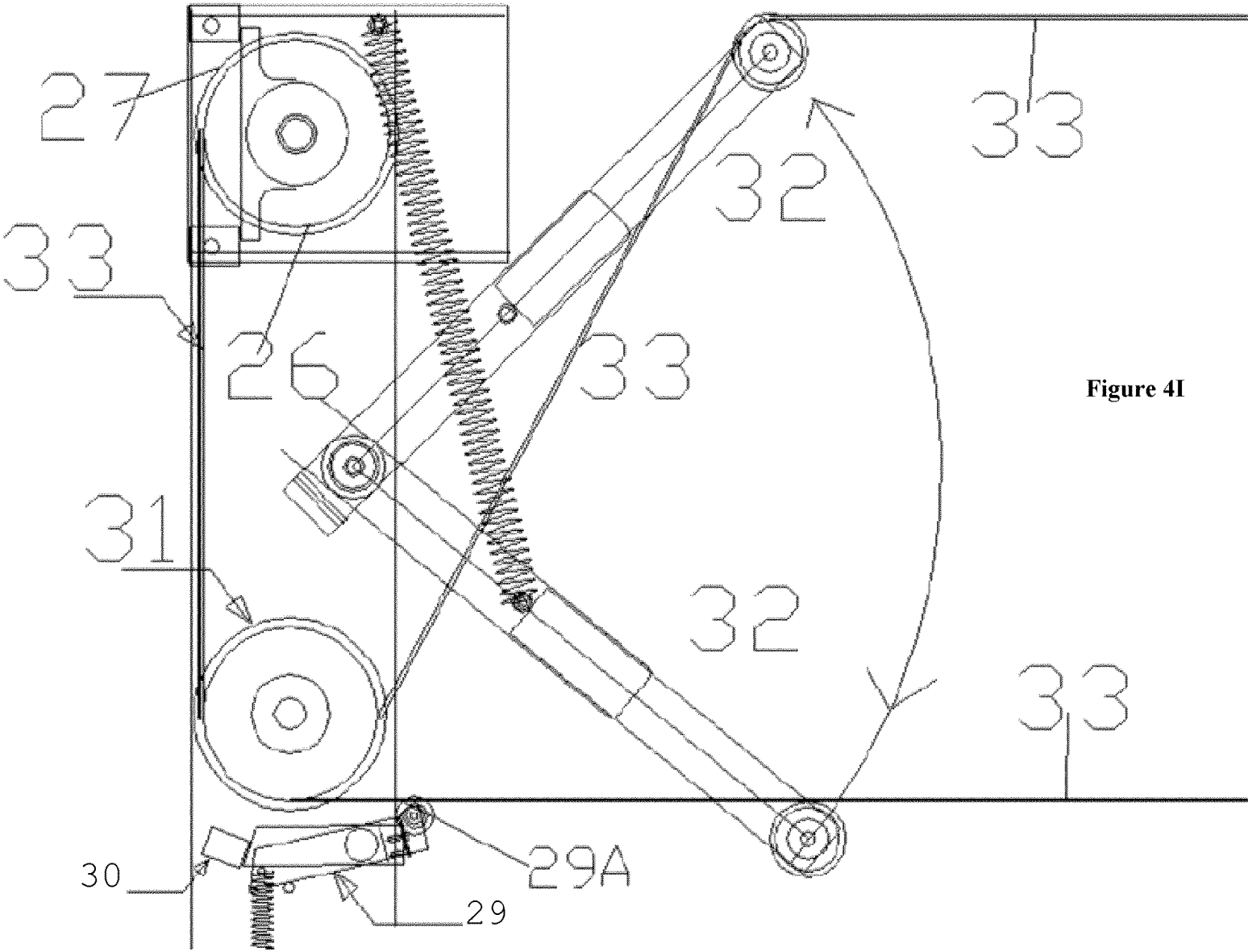
FIG. 4I is an enlarged side perspective view of an embodiment of a cable pressure sensor arm.

Reference is now made to FIGS. 4H and 4I. In some examples, a pressure sensor arm 29 is provided on at least one pair of arms 40 at one end of the sliding wheel gripper 300. When the cable 33 is lowered, in preparation for gripping the wheels 304, 305, the cable 33 hits the roller 29A of the pressure sensor arm 29. The pressure of the cable 33 against the roller 29A causes the pressure sensor arm 29 to come into proximity of a proximity sensor 30, which sends a signal that causes (e.g., via the central controller) the motor 41 to decelerate, in order to move the rotary shafts 34 and 35 slowly and smoothly under the vehicle wheels 304, 305. A cable rolling wheel 31 may also be provided above each pressure sensor arm 29. The cable rolling wheel 31 may provide tension to the cable 33 so that cable 33 is sufficiently taut to enable smooth operation of the horizontal slide frame 200 and/or the sliding wheel gripper 300 as they slide horizontally.

Reference is now made to FIGS. 5A-J, which illustrate operation of an example of the disclosed parking system.

In each multi-level parking tower, there is provided a parking bay and multiple parking spots. For example, the multi-level parking tower of FIG. 5A has one parking bay A1 and parking spots A2, A3, B1-B3. Each of the parking bay and the parking spots are provided with plates (similar to detection plate 8 described above) to enable proper alignment of the horizontal slide frame 200.

When a user is to park a vehicle, the user drives the vehicle into the parking bay A1. When the sensor detects that the vehicle is in the correct position, a signal (e.g., visual and/or audio signal) informs the user to stop. The user then exits the vehicle and the parking bay A1 and presses the "park" button on the control panel 51.

The control panel 51 may be electrically coupled to the central controller (not shown) of the parking system. Upon receiving input indicating a vehicle is in the parking bay ready to be parked, the central controller signals the motor 49 to, if necessary, move the vertical lift frame 100 (together with the horizontal slide frame 200) to the appropriate level where the vehicle is waiting.

Figure 5A:
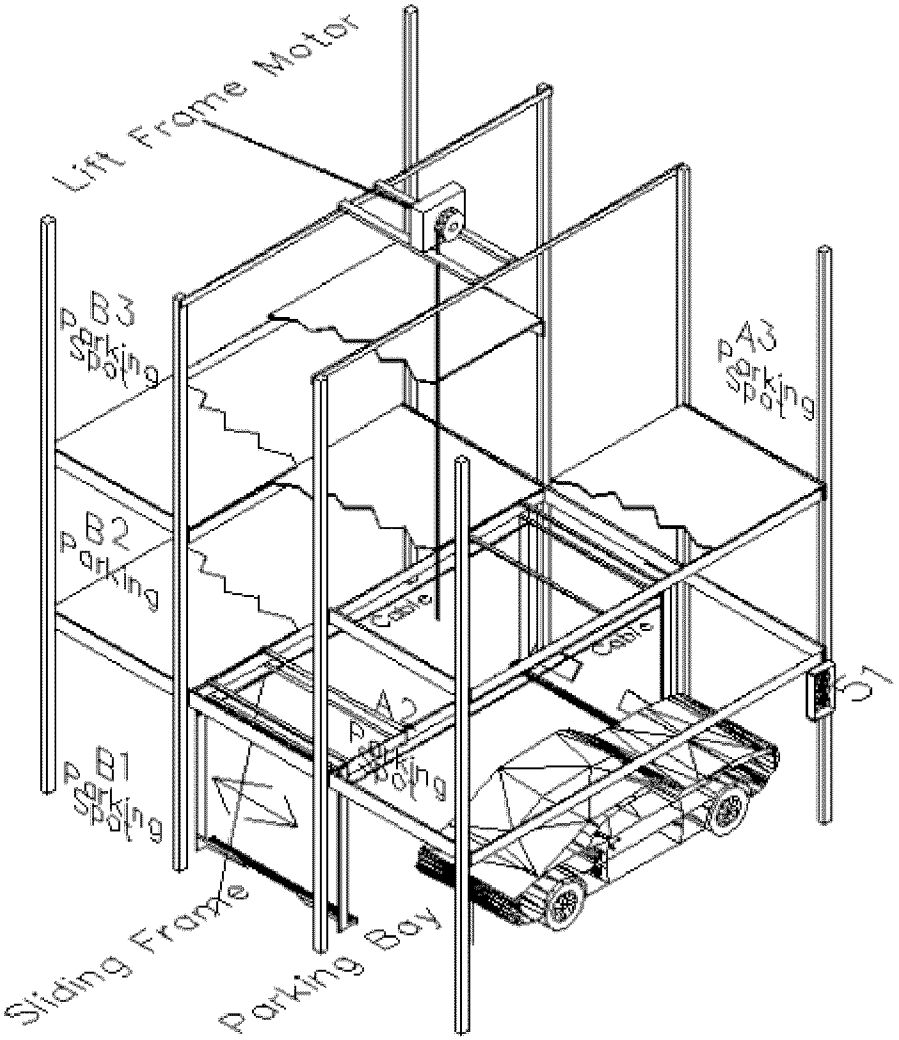
FIGS. 5A-J illustrate an operation of parking and retrieving a vehicle from a multi-level parking tower.
Figure 5B:
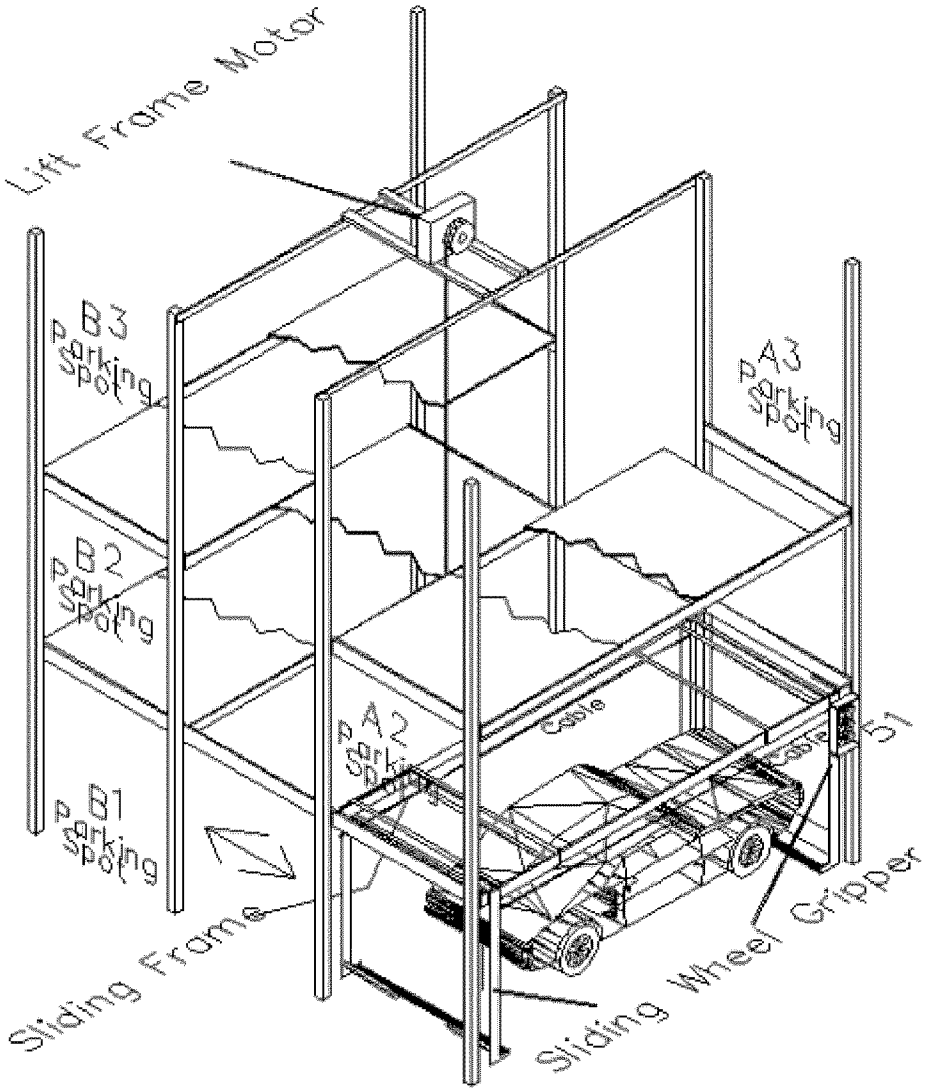

The controller then signals the motors 17 to drive the horizontal slide frame 200 to move from the middle passageway to the parking bay A1 and to dock above the vehicle, preferably within 1 to 3 seconds of the user pressing the "park" button, as shown in FIG. 5B.

Figure 5C:
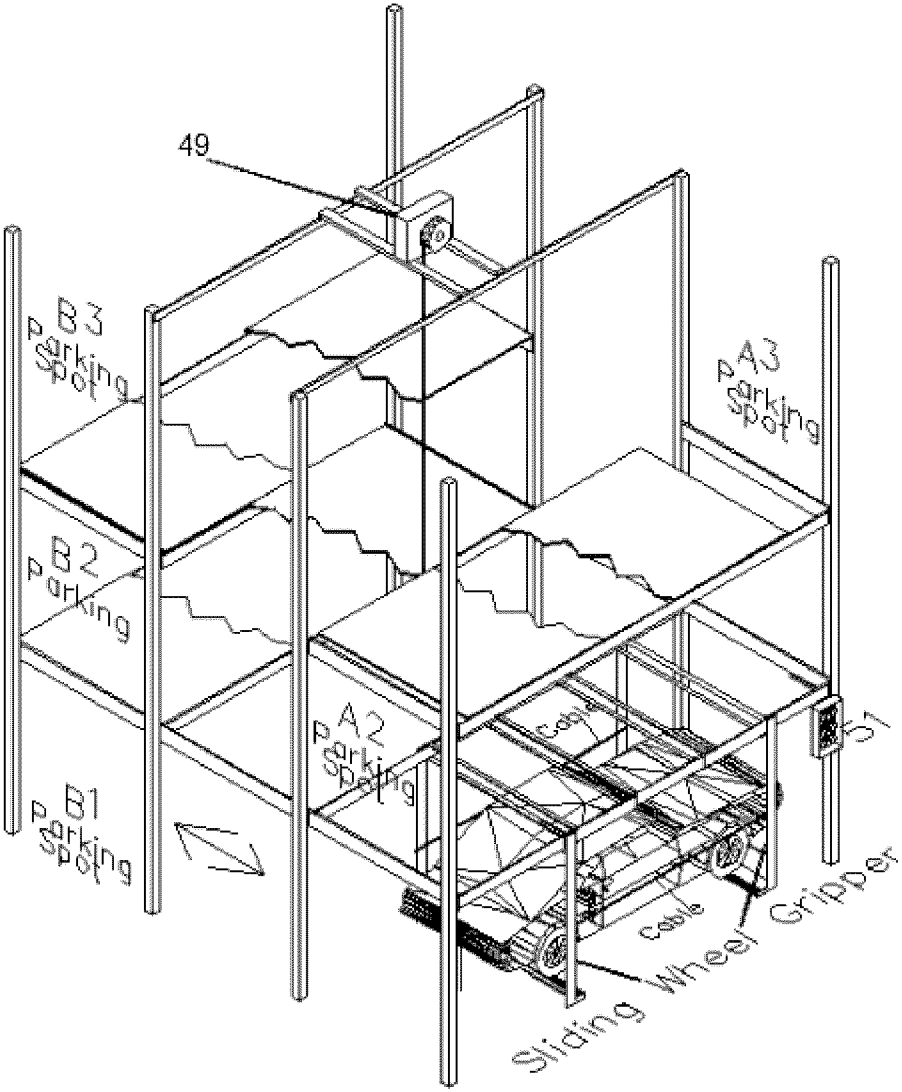
Figure 5D:
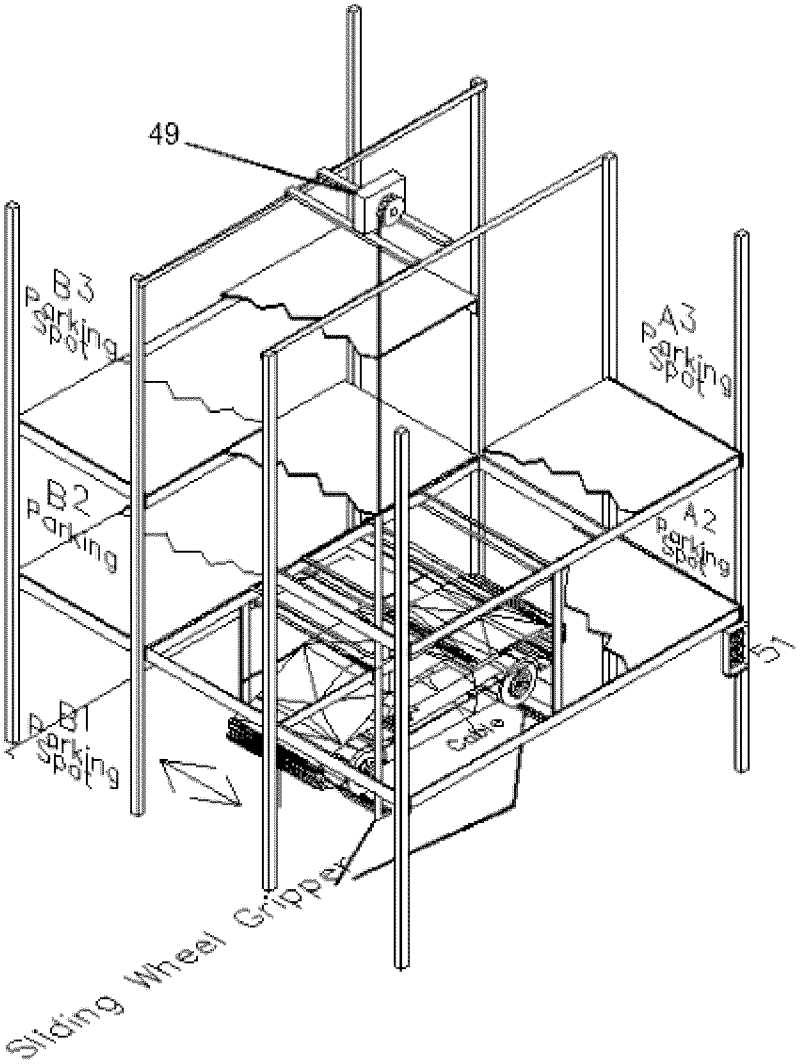
Figure 5E:
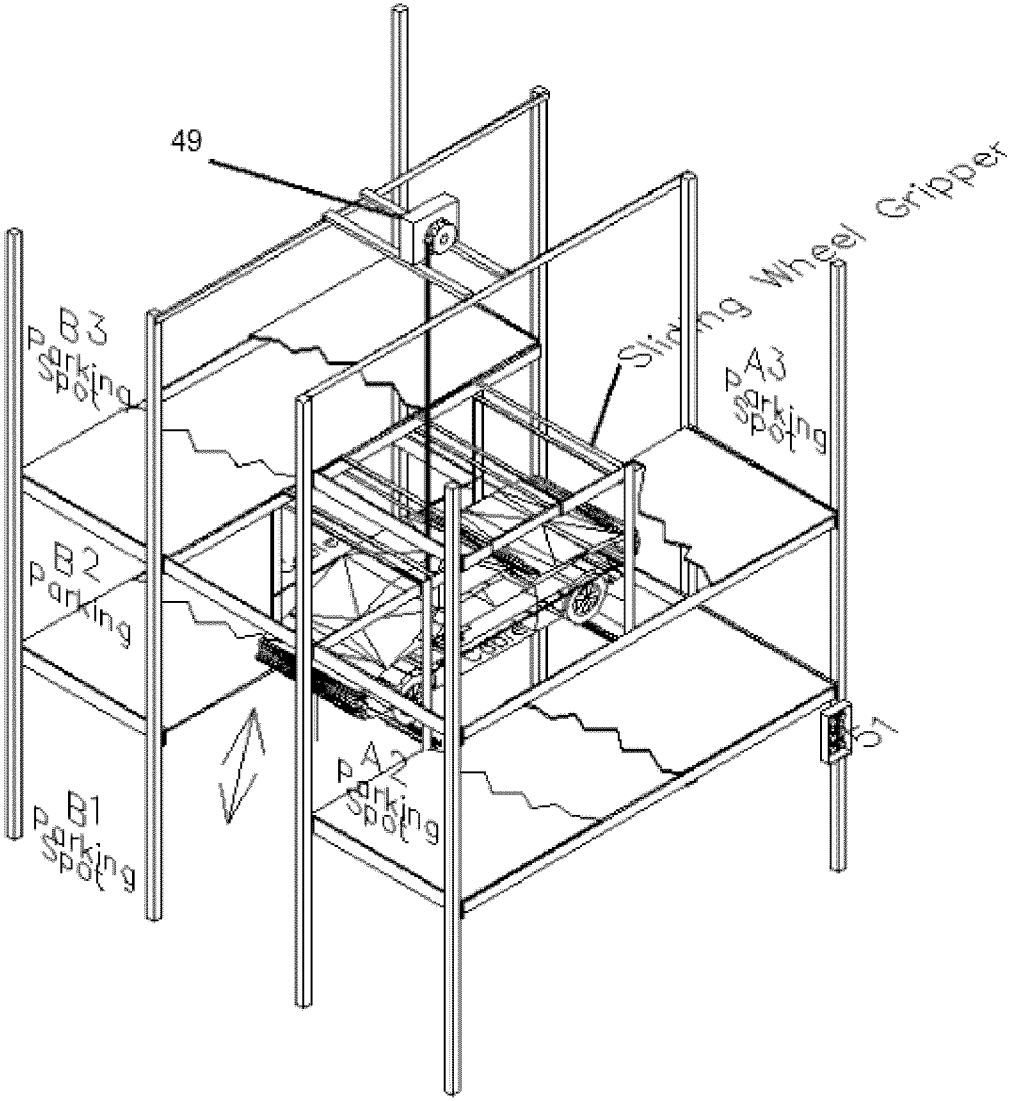

After the horizontal slide frame 200 docks in position in the parking bay A1 (e.g., as indicated by alignment of the sensing unit 14 of the horizontal slide frame 200 with a corresponding detection plate positioned in the parking bay A1), the central controller signals the sliding wheel gripper 300 to grip the vehicle, as shown in FIG. 5C. The gripping process is as described above.

After the vehicle is appropriately gripped (e.g., as detected using tension sensor arms as described above), the motors 17 are triggered by the central controller to drive the horizontal slide frame 200 to move horizontally into the middle passageway and to dock onto the vertical lift frame 100, thus moving the gripped vehicle into the middle passageway. Once the horizontal slide frame 200 fully docks onto the vertical lift frame (e.g., as indicated by alignment of the sensing unit 14 of the horizontal slide frame 200 with the corresponding detection plate 8 of the vertical lifting frame 100), the motors 17 are signaled by the central controller to stop and lock.

At least one sensor (not shown) is provided to determine which parking spot is available. The sensor is triggered to scan each level for an available parking spot. For example, if parking spot B1 is available, then the sensor sends a signal to the central controller to trigger the pin system to anchor the vertical lift frame 100 (if not already anchored) and signal the motors 17 to drive the horizontal slide frame 200 to move horizontally into the parking spot B1 and release the vehicle therein.

If no parking spot is available at this level, a signal is sent to the motor 49 to vertically move the vertical lift frame 100 (e.g., to elevate to higher levels). In some examples, the signal to vertically move the vertical lift frame 100 is sent only if the sensing unit 14A on the vertical lift frame 100 indicates that the horizontal slide frame 200 is properly aligned. During elevation, the sensor scans left and right on each level to determine whether a parking spot is available. Once an available parking spot is identified, signal is sent to the motor 49 to stop at the level where the available parking spot is and for the pin system to anchor the vertical lift frame 100 at the desired level. If both the left and right parking spots are available, a signal may be sent to use either one. In some examples, the one on the left, i.e., away from the parking bay A1, is preferred. When a parking spot is detected on a given level, the motor 49 is triggered to stop when the vertical lift frame 100 is substantially level with the fixed members 3 of that level (e.g., as determined according to the pin system described above).

Figure 5F:
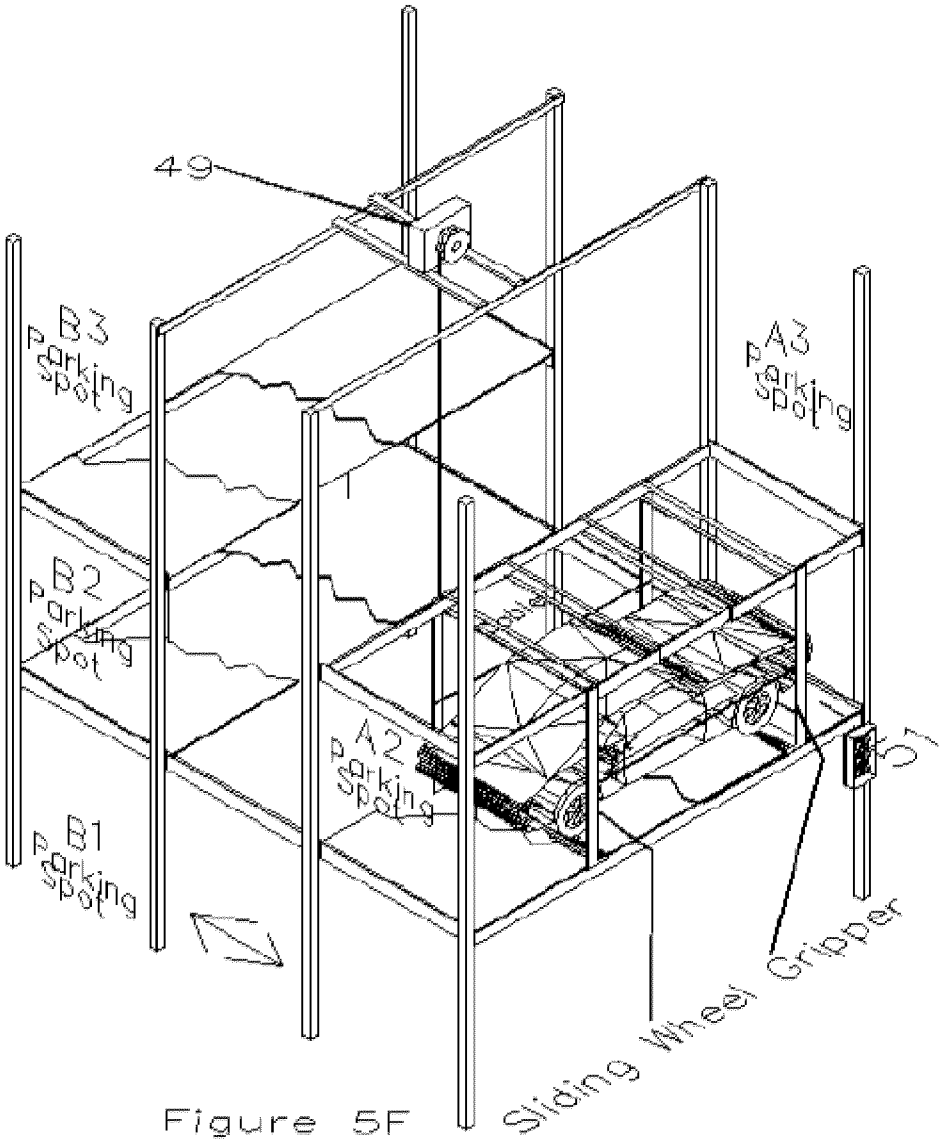

In FIG. 5F, the right parking spot A2 is selected (e.g., if the left parking spot B2 is already occupied). Once the parking spot to be used is determined, the central controller controls the motors 17 to drive the wheels 19 to move the horizontal slide frame 200 into the designated parking spot. After the horizontal slide frame 200 is correctly positioned (e.g., as indicated by alignment of the sensing unit 14 of the horizontal slide frame 200 with a corresponding detection plate positioned in the parking spot B2), the motors 17 stop and lock.

The selected parking spot for the vehicle may be identified by the central controller. The user may be informed of the selected parking spot for the vehicle, for example via a visual display on the control panel 51. Alternatively or additionally, the user may be provided with a unique code for later retrieving the vehicle. The unique code may be generated by the control panel 51 and stored by the control panel 51 in association with the selected parking spot of the vehicle. The use of a unique code may provide a security feature to ensure that the vehicle is not retrieved by another user.

Figure 5G:
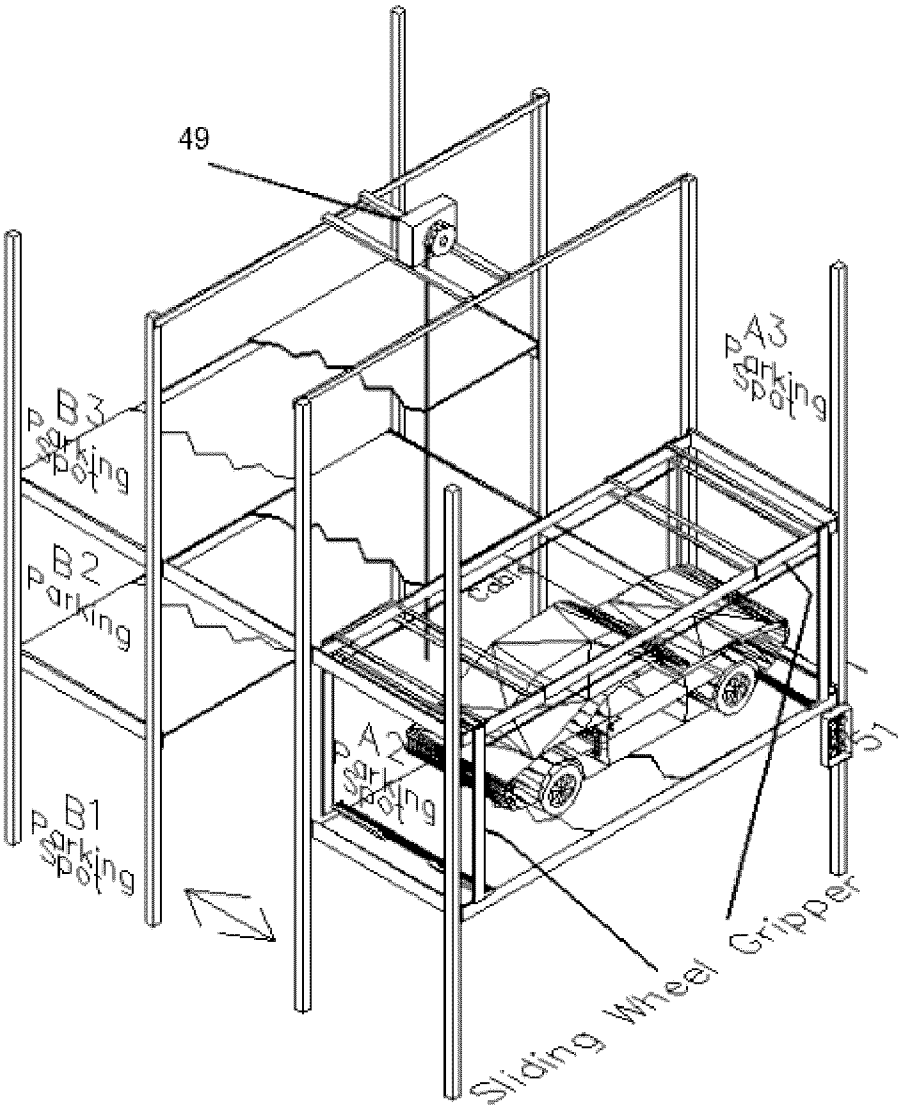

As shown in FIG. 5G, the central controller controls the motors 28 and 41 to cause the sliding wheel gripper 300 to release the vehicle to land on the parking spot. After the wire 33 is lifted up above the vehicle and the sliding wheel gripper 300 is in the fully open position, the motors 28 and 41 stop and lock.

Figure 5H:
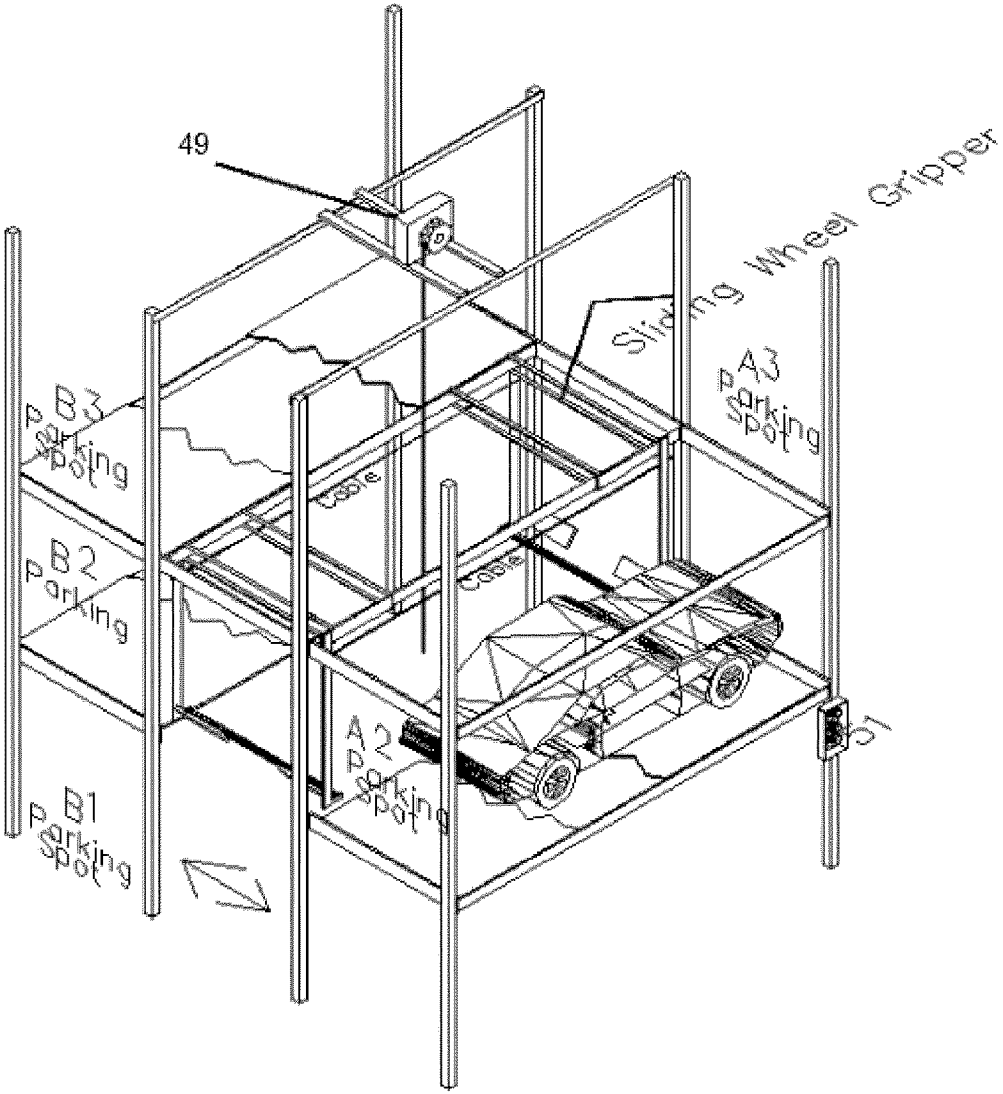

FIG. 5H shows that the central controller then controls motors 17 to drive the horizontal slide frame 200 back to the middle passageway to attach to the vertical lift frame 100. After the horizontal slide frame 200 is correctly positioned on the vertical lift frame 100, the motors 17 stop and lock and the system comes into a standby position. In some examples, the vertical life frame 100 may be lowered (after the pin system is released to the unanchored position) to the lowest level (e.g., as in FIG. 5A), so that it is readily available to park another car.

When a user is ready to retrieve a vehicle, the user inputs the parking spot number (or unique code) into the control panel 51. The system operates in a process that is reverse of the process for parking the vehicle in a designated parking spot and moves the vehicle into the parking bay A1. If the user inputted the parking spot number, the system simply retrieves the vehicle from the identified parking spot. If the user inputted a unique code, the central controller may identify the parking spot associated with the unique code and accordingly retrieve the vehicle from that parking spot.

Figure 5I:
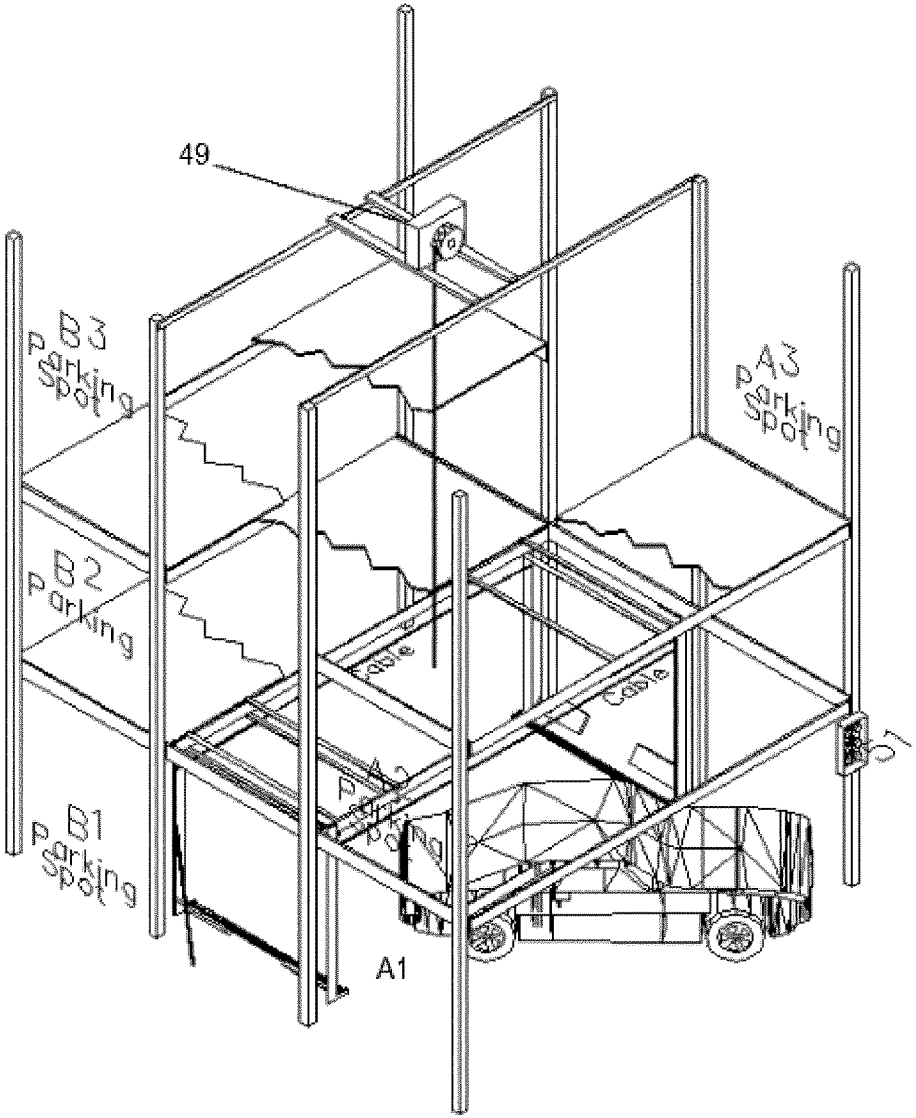
Figure 5J:
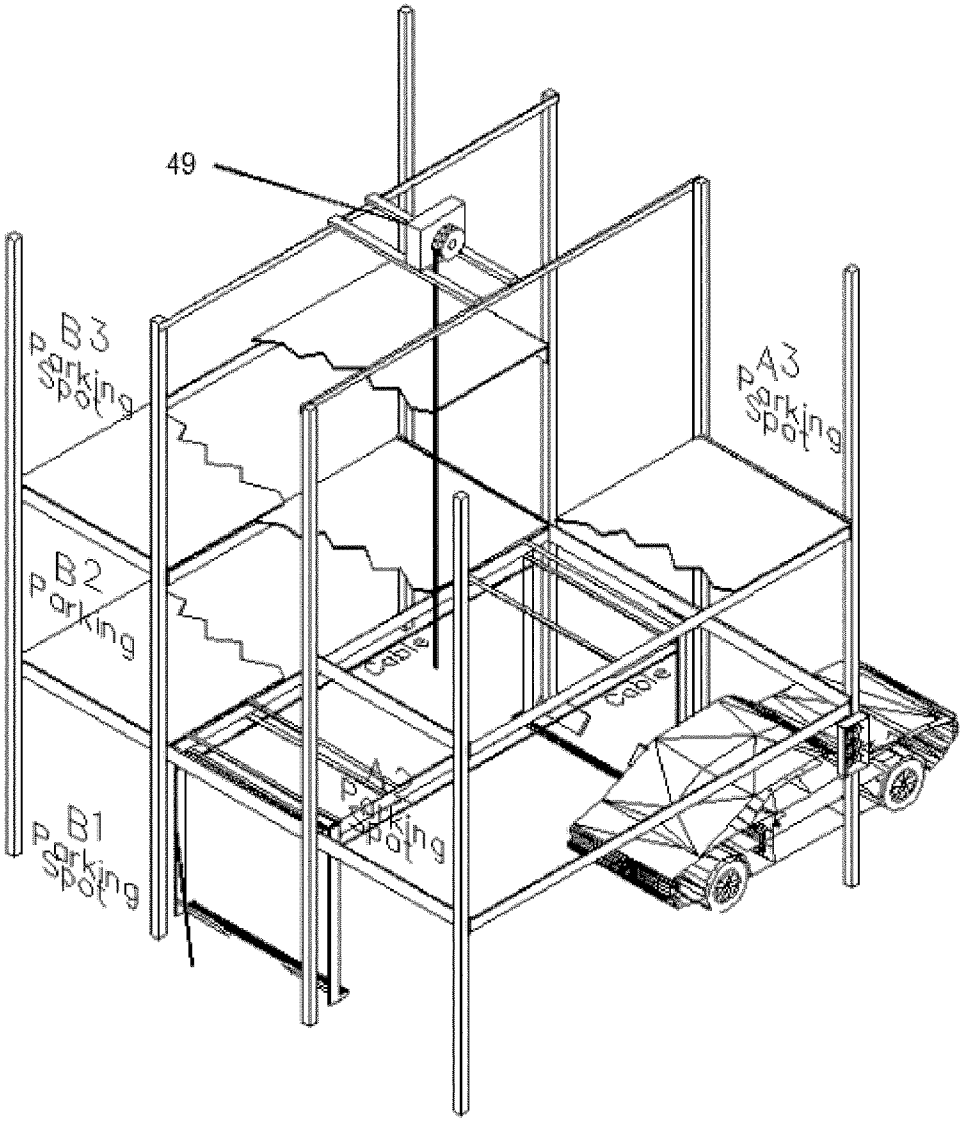

The user then enters the vehicle and drives the vehicle to exit either from the side as shown in FIG. 5I or from the front as shown in FIG. 5J.

Two or more multi-level parking towers, as described above, may be used together in a parking system. For example, two or more such towers may be placed end-to-end and/or side-by-side. By using multiple multi-level parking towers, which are capable of operating independently and simultaneously, the parking system may serve to park and/or retrieve multiple vehicles simultaneously, thus reducing the wait to park or retrieve vehicles.

The multi-level parking towers may be shipped fully-assembled for efficient freight and speeds up on-site installation. In some examples, the vertical lift frame, horizontal slide frame and sliding wheel gripper may be shipped assembled together.

The multi-level parking tower may be designed with suitable vertical height to accommodate a certain desired maximum vehicle height and/or to fit a desired total height of a parking garage.

The parking system may be used underground, above ground or as a combination of both.

Solar or electricity powered electric vehicle (EV) chargers may be installed in designated parking spots. Solar panels may be installed on top of the multi-level parking towers (e.g., where the tower is located at least partially above-ground) for generating electricity to charge the vehicles and/or operate the motors used to lift and lower the vehicles.

Although the present disclosure describes the use of particular arrangements for sensing position, tension and pressure, among others, it should be understood that other sensing systems may be suitable. For example, instead of using sensing arrangements based on proximity sensors, position sensors, contact sensors, pressure sensors, piezo-electric sensors, optical sensors, infrared sensors or other sensing means may be used.

In some applications, the use of proximity sensors may be desirable in order to achieve a more robust system, for example with lower failure rate, less maintenance and/or greater accuracy.

The use of mechanical arrangements for vertical positioning and horizontal positioning, for example, may be desirable in certain applications for lower failure rate, less maintenance and/or greater accuracy, compared to a software-controlled arrangement.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

All values and sub-ranges within disclosed ranges are also disclosed. Also, although the systems, devices and processes disclosed and shown herein may comprise a specific number of elements/components, the systems, devices and assemblies could be modified to include additional or fewer of such elements/components. For example, although any of the elements/components disclosed may be referenced as being singular, the embodiments disclosed herein could be modified to include a plurality of such elements/components. The subject matter described herein intends to cover and embrace all suitable changes in technology.

The invention claimed is:

1. A vehicle gripping system, comprising:

a sliding wheel gripper slidably coupled to and extending downwards from an upper frame, for releasably gripping a vehicle by gripping the wheels of the vehicle;

the sliding wheel gripper being longitudinally slidable along the upper frame between a release position and a gripping position;

the sliding wheel gripper comprising first and second arms extending downwards from the upper frame;

first and second gripping devices disposed at an end of the first and second arms, respectively, for gripping the vehicle therebetween; and a first arm driving system for moving the first and second arms away from each other, and a second arm driving system for moving the first and second arms towards each other;

wherein the first and second arms are longitudinally movable towards each other to the gripping position to enable gripping of the vehicle therebetween, and longitudinally movable away from each other to the release position to enable release of the vehicle;

wherein the first and second arm driving systems are configured to cause movement of the first and second arms away from each other to release the vehicle to be at a slower speed than movement of the first and second arms towards each other to grip the vehicle; and wherein the sliding wheel gripper comprises a first top frame and a second top frame slidably movable in opposite directions relative to the upper frame, and wherein the first and second arms extend downwardly from the first and second top frames, respectively.

2. The system of claim 1, wherein each of the first and second gripping devices comprises:

two rotary shafts for supporting the vehicle wheel thereupon; and a liftable stopper for gripping a side of the vehicle wheel;

wherein the vehicle is gripped between the first and second gripping devices by pressure from the respective stoppers.

3. The system of claim 2, wherein each of the first and second gripping devices further comprises:

a rotary mechanism to cause the liftable stopper to move from a rest position to a raised gripping position.

4. The system of claim 1, further comprising a lifting arm for moving the second arm driving system between an upper position and to a lower position.

5. The system of claim 4, further comprising:

at least one pressure sensing unit on at least one arm;

wherein the pressure sensing unit is configured to detect lowering of the second arm driving system to the lower position; and wherein the pressure sensing unit is configured to cause the second arm driving system to decelerate movement of the first and second arms towards each other.

6. The system of claim 1, further comprising:

a tension sensing unit positioned to sense tension in the second arm driving system;

wherein the tension sensing unit is configured to detect when tension in the second arm driving system reaches a threshold tension indicating a vehicle has been gripped; and wherein the tension sensing unit is configured to cause the second arm driving system to stop movement of the first and second arms.

7. The vehicle gripping system of claim 1, wherein the first arm driving system is a first chain system, and the second arm driving system is a second chain system.

8. A parking tower, comprising:

a structure having at least two levels and a vertical passageway;

a vehicle gripping system, the vehicle gripping system comprising:

a vertical lift frame vertically movable in the passageway;

a horizontal slide frame slidably coupled to the vertical lift frame and horizontally movable relative to the vertical lift frame and across each level; and a sliding wheel gripper slidably coupled to and extending downwards from the horizontal slide frame, for releasably gripping a vehicle by gripping the wheels of the vehicle, the sliding wheel gripper being longitudinally slidable along the horizontal slide frame between a release position and a gripping position;

wherein the sliding wheel gripper comprises:

first and second arms extending downwards from the horizontal slide frame;

first and second gripping devices disposed at an end of the first and second arms, respectively, for gripping the vehicle therebetween; and a first arm driving system for moving the first and second arms away from each other, and a second arm driving system for moving the first and second arms towards each other;

wherein the first and second arms are longitudinally movable towards each other to the gripping position to enable gripping of the vehicle therebetween, and longitudinally movable away from each other to the release position to enable release of the vehicle;

wherein the first and second arm driving systems are configured to cause movement of the first and second arms away from each other to release the vehicle to be at a slower speed than movement of the first and second arms towards each other to grip the vehicle; and wherein the sliding wheel gripper comprises a first top frame and a second top frame slidably movable in opposite directions relative to the horizontal slide frame, and wherein the first and second arms extend downwardly from the first and second top frames, respectively; and wherein at least one parking bay and at least one parking spot is defined in the structure, each of the parking bay and parking spot being provided with horizontal fixed members to enable horizontal movement of the horizontal slide frame across the respective parking bay and parking spot.

9. The parking tower of claim 8, wherein the vehicle gripping system further comprises:

a pin system comprising:

retractable pins movable between an unanchored position and an anchored position, wherein the anchored position of the retractable pins causes the vertical lift frame to be anchored to the fixed members of the parking spot or parking bay;

orientation sensing units configured to sense orientation of the retractable pins, orientation of the retractable pins being indicative of whether the vertical lift frame is substantially level with the fixed members of the parking spot or parking bay, the orientation sensing units being configured to cause vertical movement of the vertical lift frame to stop when the vertical lift frame is substantially level; and biasing members controllable to cause movement of the retractable pins between the unanchored position and the anchored position.

10. The parking system of claim 9, wherein the vertical lift frame is substantially level when there is a vertical difference of 0.5 mm or less between the vertical lift frame and the fixed members.

11. A parking system comprising a plurality of parking towers, wherein each parking tower comprises:

a structure having at least two levels and a vertical passageway;

a vehicle gripping system, the vehicle gripping system comprising:

a vertical lift frame vertically movable in the passageway;

a horizontal slide frame slidably coupled to the vertical lift frame and horizontally movable relative to the vertical lift frame and across each level; and a sliding wheel gripper slidably coupled to and extending downwards from the horizontal slide frame, for releasably gripping a vehicle by gripping wheels of the vehicle, the sliding wheel gripper being longitudinally slidable along the horizontal slide frame between a release position and a gripping position;

wherein the sliding wheel gripper comprises:

first and second arms extending downwards from the horizontal slide frame;

first and second gripping devices disposed at an end of the first and second arms, respectively, for gripping the vehicle therebetween; and a first arm driving system for moving the first and second arms away from each other, and a second arm driving system for moving the first and second arms towards each other;

wherein the first and second arms are longitudinally movable towards each other to the gripping position to enable gripping of the vehicle therebetween, and longitudinally movable away from each other to the release position to enable release of the vehicle;

wherein the first and second arm driving systems are configured to cause movement of the first and second arms away from each other to release the vehicle to be at a slower speed than movement of the first and second arms towards each other to grip the vehicle; and wherein the sliding wheel gripper comprises a first top frame and a second top frame slidably movable in opposite directions relative to the horizontal slide frame, and wherein the first and second arms extend downwardly from the first and second top frames, respectively; and wherein at least one parking bay and at least one parking spot is defined in the structure, each of the parking bay and parking spot being provided with horizontal fixed members to enable horizontal movement of the horizontal slide frame across the respective parking bay and parking spot.

* * * * *